United States Patent [19]

Peszeszer

[11] 4,005,828

[45] Feb. 1, 1977

[54] METHOD AND APPARATUS FOR STRESSING A TENDON AND BANDING A STRUCTURE

[75] Inventor: Endre F. Peszeszer, San Diego, Calif.

[73] Assignee: General Atomic Company, San Diego, Calif.

[22] Filed: May 6, 1975

[21] Appl. No.: 574,900

[52] U.S. Cl. ..... 242/7.21; 242/7.23; 242/147 R; 226/172; 226/195

[51] Int. Cl.[2] ..... B21F 17/00; B21F 45/00

[58] Field of Search ..... 242/7.21, 7.22, 147 R, 242/7.23; 226/172, 195

[56] References Cited

UNITED STATES PATENTS 3,687,380 8/1972 Magers et al. ..... 242/7.21

*Primary Examiner*—Richard E. Aegerter
*Assistant Examiner*—Willis Little
*Attorney, Agent, or Firm*—Fitch, Even, Tabin & Luedeka

[57] ABSTRACT

A method and apparatus are disclosed for banding a vertical wall of a large vessel with a highly tensioned tendon payed out from a traveling carriage being driven about the vertical wall. The carriage is suspended from the structure and a circumferential restraining means constrains a primary set of traction wheels driven by a primary hydraulic system and a second set of wheels driven by regenerative hydraulic system into frictional engagement with the vessel wall. The preferred wheels comprise hydraulic motors having an outer rotatable portion or race to which is directly attached an encircling tire. A tendon tensioning mechanism is disclosed with restraining elements having outer frictional surfaces engaging the tendon without slipping and having other frictional surfaces for slipping relative to a force applying means when accommodating elongation of the tendon during tensioning. Also, a tendon tensioning means is mounted to pivot about a vertical axis to position the tendon for travel along a tangential path to the structure and about a horizontal axis to prevent bending of the tendon as it discharges from the tendon tensioning means.

35 Claims, 21 Drawing Figures

FIG. 20
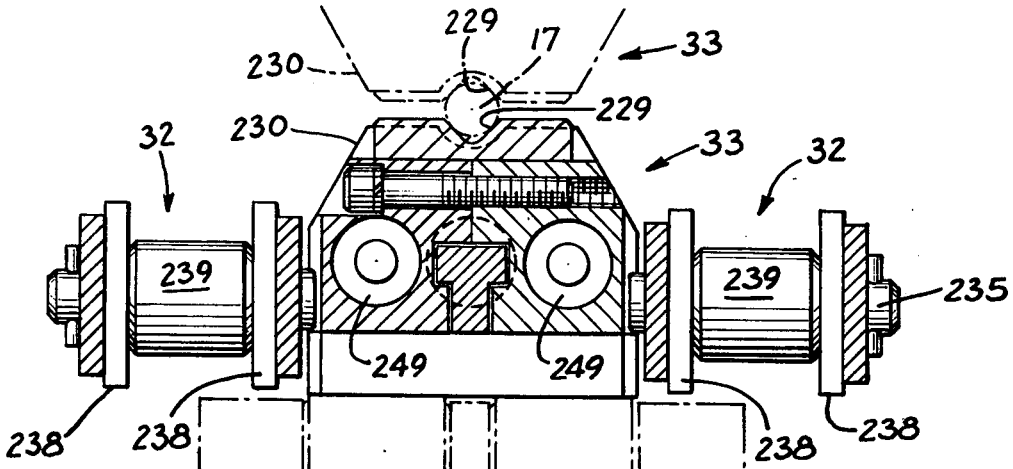
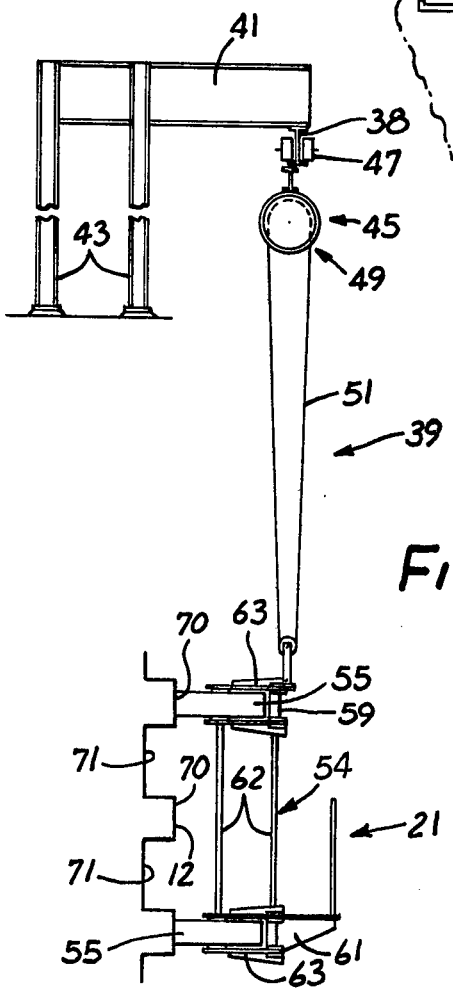
FIG. 5

METHOD AND APPARATUS FOR STRESSING A TENDON AND BANDING A STRUCTURE

This invention relates to an apparatus and method for prestressing by banding structures circumferentially with tensioned tendons, and more particularly to an apparatus and method in which a carriage moves about a structural wall while tensioning the tendon and paying out the tensioned tendon to the structural wall.

The present invention is an improvement over the prestressing apparatus and method disclosed in U.S. Pat. No. 3,687,380. The apparatus disclosed in that patent includes a carriage carrying a supply reel of the tendon movable circumferentially about a large cylindrical structure, for example, 100 feet in diameter, with a tension tendon being payed out along a tangential line from the tendon tensioning device to the wall of the structure to substantially eliminate the bending stresses applied to tendon by the usual prior art tendon tensioning mechanisms. The tendons are of high tensile steel and are relatively thick, for example, up to 0.6 inch diameter, and are highly stressed and laid in grooves. As much as twelve hundred miles of tensioned tendon may be laid by such apparatus on a single structure with the tendons being laid in grooves formed in the structural wall and circumferentially stacked in several layers in the grooves. That is, the tendons are laid side by side in the vertical direction and tightly packed within the grooves in the wall of the structure and more than one layer of tendons is laid in each groove.

In the aforementioned patent, the tendon tensioning mechanism was pivotally mounted so as to maintain the tendon aligned with and traveling along a tangential path during a buildup of successive convolutions of the tendon and to accommodate different sizes or diameters of wall structures. The tendon tensioning mechanism comprised a pair of endless bands with restraining elements thereon for gripping the tendon for applying tension thereof. The restraining elements were shiftable relative to the endless bands to accommodate elongation of the tendon as it went from zero prestressing to the maximum stressed condition. A load cell measured the tension force being applied by the restraining elements and this was used to control the drive to maintain the stress at a predetermined level.

Also, in the aforementioned patent, the carriage was moved vertically and held against falling by a suspension system which included cables extending vertically to a supporting framework at the top of the structure. A restraining system including some circumferentially extending bands pressed the carriage against the wall. The tendon tensioning mechanism was movable vertically within a short range, for example, six or seven feet, on the traveling carriage before the carriage had to be shifted by the suspension mechanism to resume banding the wall at other grooves therein.

The traction drive for moving the carriage circumferentially about the structural wall, in the aforementioned patent, included caterpillar tracks which engaged the wall over relatively wide surfaces and imparted a driving motion to the carriage while paying out the tension tendon. The traction drive could be driven in both the forward and reverse directions while tensioning the tendon; and a regenerative motor drive system reduce the power needed for the traction drive. More specifically, the work encountered in tensioning the tendon was used to drive hydraulic pumps which were connected to regenerative motors coupled through gear boxes to the caterpillar track drive.

The aforementioned method and apparatus of U.S. Pat. No. 3,687,380 substantially eliminated the bending stresses in the tendons of prior art devices and payed out the tensioned tendon along a tangential path to the wall; but difficulty was experienced in operation for extended periods of time. For instance, the gear boxes in the caterpillar traction drive often broke under the heavy loads applied thereto. Also, the tension in the cable could not be controlled as precisely and uniformly as desired with the hydraulic system employed therein. In the tendon stressing mechanism disclosed in the aforementioned patent, the restraining elements were not uniformly loaded along the length of the tendon and the normal force required to grip the cable to prevent slipping had to be maintained at high levels to prevent slipping of the restraining elements along the tendon. Also, as the restraining elements released the tendon, the restraining elements snapped back with considerable force causing wear and breakage. The snapping back of the restraining elements was noisy.

The tendons were packed tightly in a groove and were payed out on the substantially tangential path to the structure. However, it sometimes occurred that the tendon leaving the stressing head experienced a slight downward bending about a horizontal axis, for instance, about one-half degree. This slight bending of tendons at an angle is called the "fleet" angle. Because the tendon was so highly stressed, it was desired to reduce and eliminate even this small fleet angle bending.

Accordingly, a general object of the invention is to provide an improved, as contrasted with the above-described prior art, apparatus and method for prestressing a structure.

Other objects and advantages of the invention will become apparent from the following detailed description taken in connection with the drawings, in which:

FIG. 5 is a side view of the suspension system of FIG. 3;

FIG. 20 is a cross-sectional view partially in section of the restraining elements shown in FIGS. 15, 17, 18 and 19.

Figure 1:
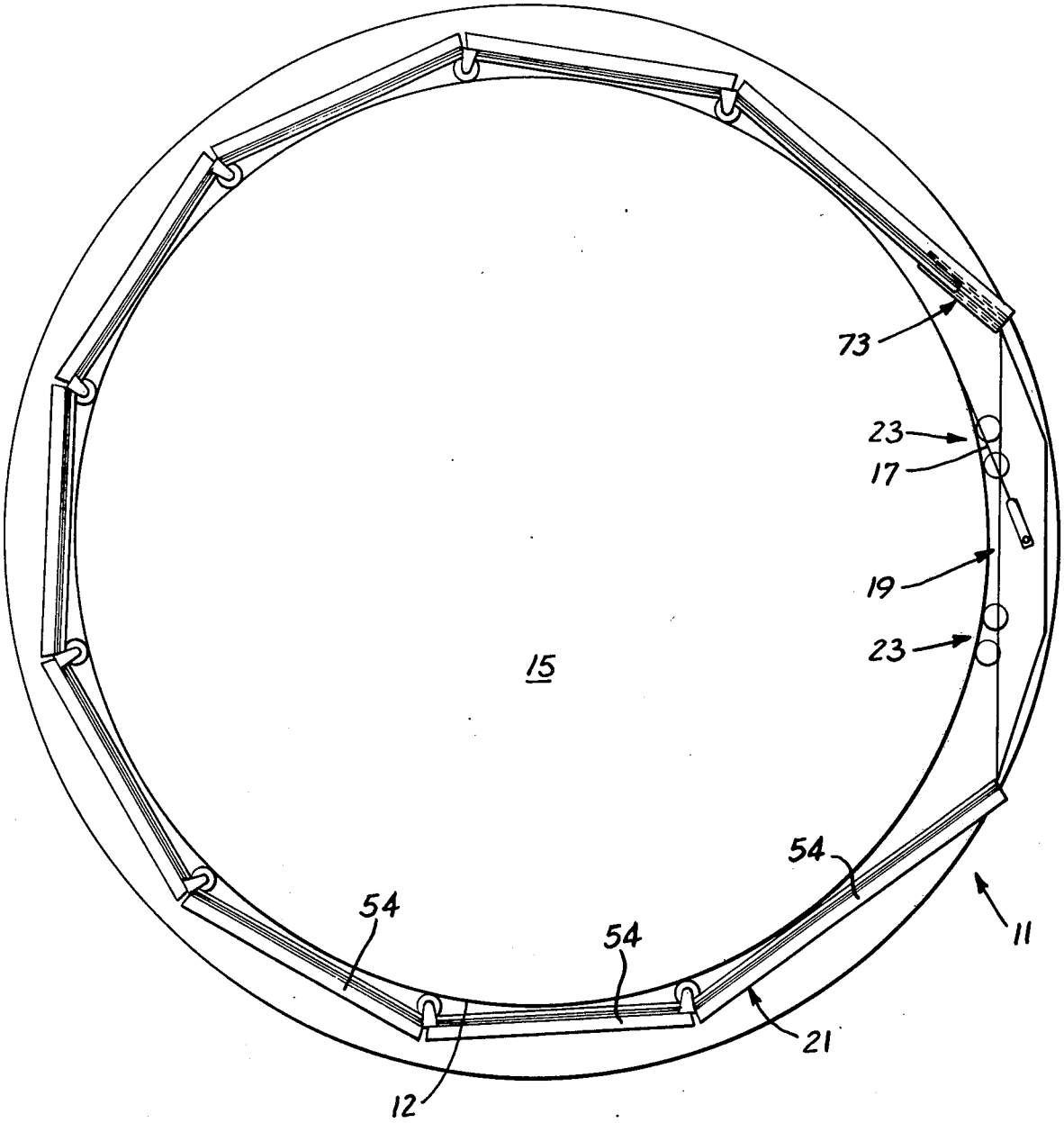
FIG. 1 is a plan view illustrating an apparatus for prestressing a structure and capable of carrying out the method of the invention.

As shown in the drawings for the purposes of illustration, the invention is embodied in an apparatus 11 for banding a wall 12 of a structure 15 such as a restraining barrier or tank formed of concrete or reinforced concrete or steel, with stressed tendons 17. The stressed tendons are highly stressed and develop compressive forces in the wall 12 to prestress it circumferentially before an internal pressure is applied from within the structure. Although not limited to any particular size of structure 15 or tendon 17 or operational speed of banding the structural wall, the illustrated apparatus is particularly suited for banding very large structures, e.g., 100 feet or more in diameter, with large tendons, for example, 0.6 inch diameter steel cables and for banding at relatively high speeds such as, for example, 300 feet per minute. Moreover, the tendons are highly stressed, e.g., to 30,000 lbs. which is about 75% of the yield strength of a 0.5 inch diameter steel cable; and therefore the stressing is monitored and carefully controlled not to exceed a predetermined stress level. Also, bending stresses applied to the tendon 17 by even relatively small bends, for example, a one-half degree to one degree bend, have been found to be undesirable.

Figure 2:
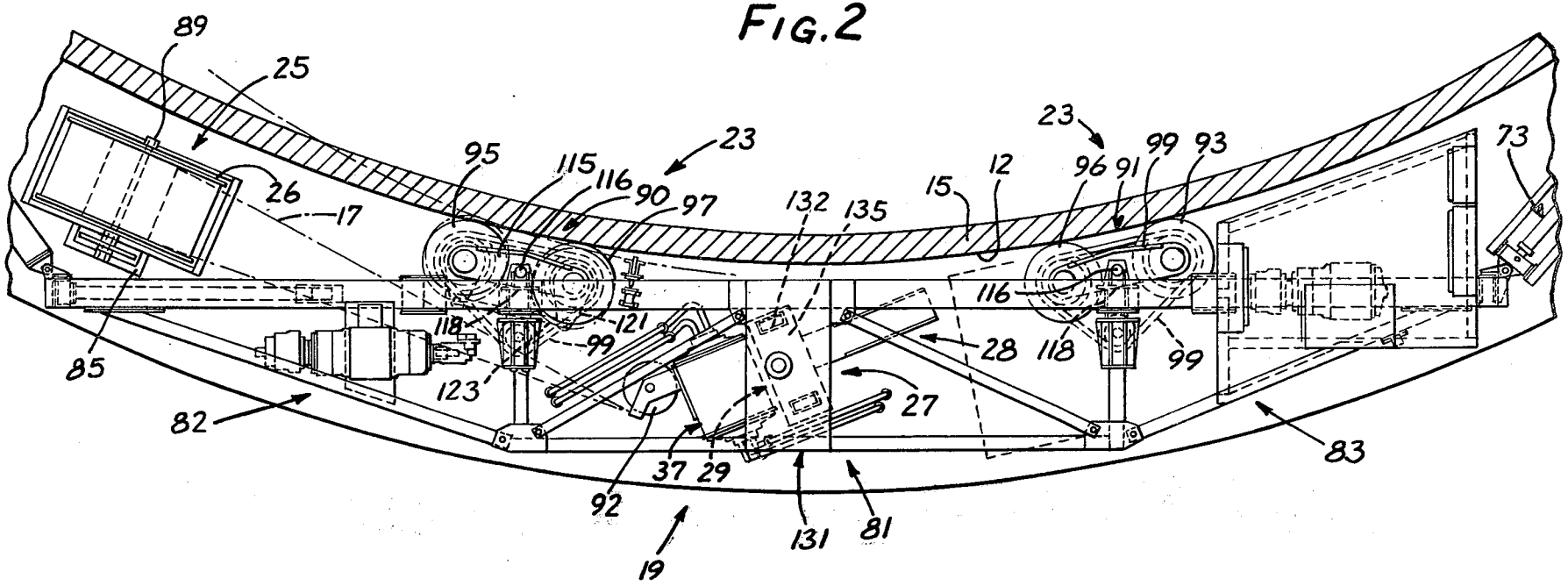
FIG. 2 is a plan view of the carriage with the structural wall shown partially in section for banding in accordance with the invention.

As disclosed in U.S. Pat. No. 3,687,380, the tendon 17 issues from a traveling carriage 19 which is constrained against the wall 12 of the vessel by a restraining system 21 to afford good traction therewith for a traction drive means 23 which is in driving engagement with the structural wall 12 to propel the carriage forwardly while paying out the stressed tendon rearwardly from the carriage. As will be explained, the traction drive means may be driven in the reverse direction to take up the tendon while maintaining the tendon 17 under tension. The carriage 19 carries a reel means 25, as best seen in FIG. 2, carrying a large spool 26 on which is wound a coil of unstressed tendon 17 which is unwound from the spool and payed out to a tendon tensioning means 27. As disclosed in the aforementioned patent, the tendon tensioning means 27 comprises a prestressing unit or tendon tensioning mechanism 28 which engages the tendon 17 over an extended linear portion thereof for applying tensile forces thereto as the tendon travels along a substantially straight line path of movement which is in alignment with a tangent to the wall 12 of the structure. The prestressing unit 28 is mounted by articulating means 29 on the carriage 19 to maintain the straight line tangential path for the tendon 17 without imparting any substantial bending stresses thereto.

Figure 11:
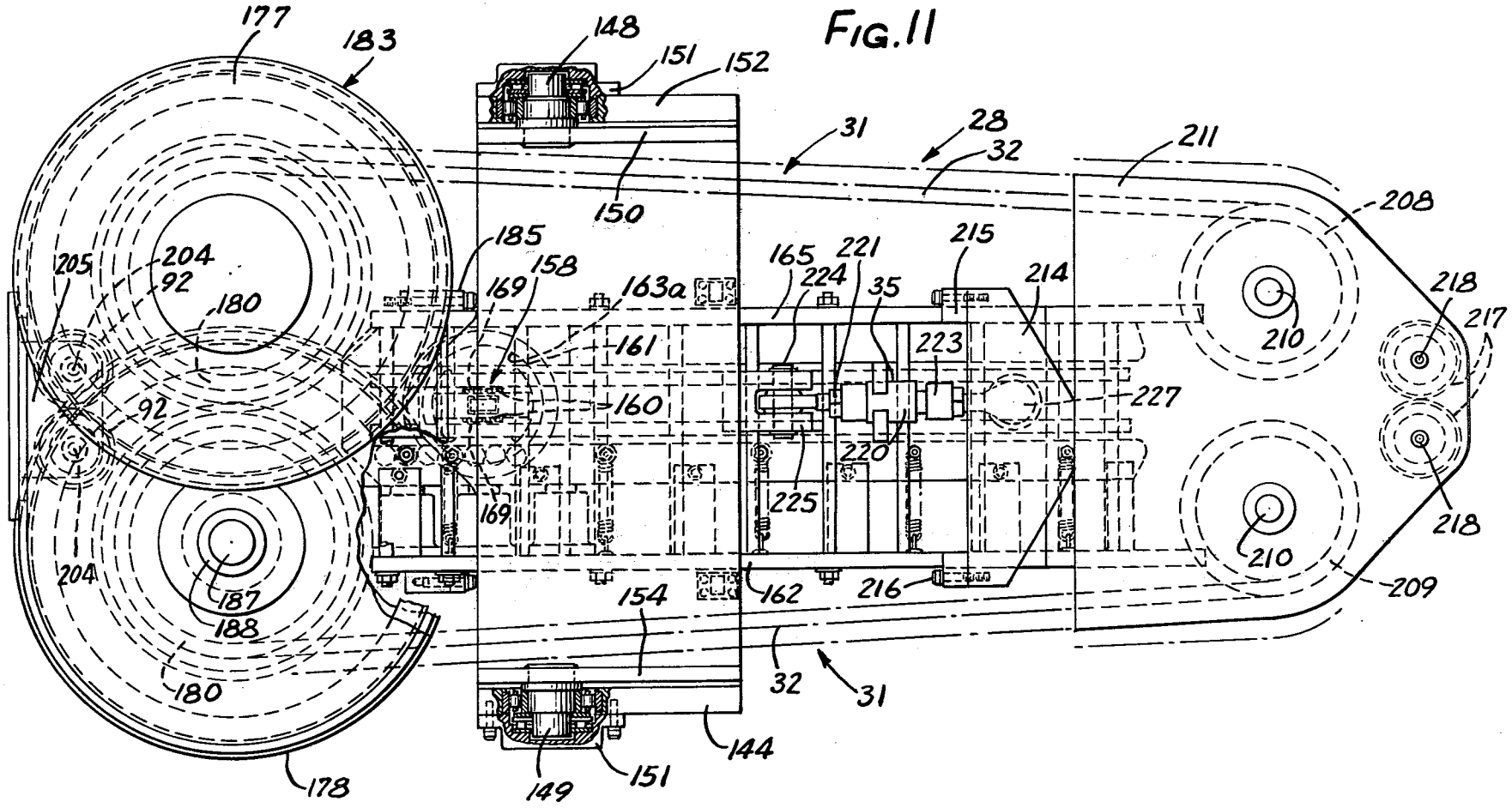
FIG. 11 is an elevational view of the tendon tensioning mechanism.
Figure 16:
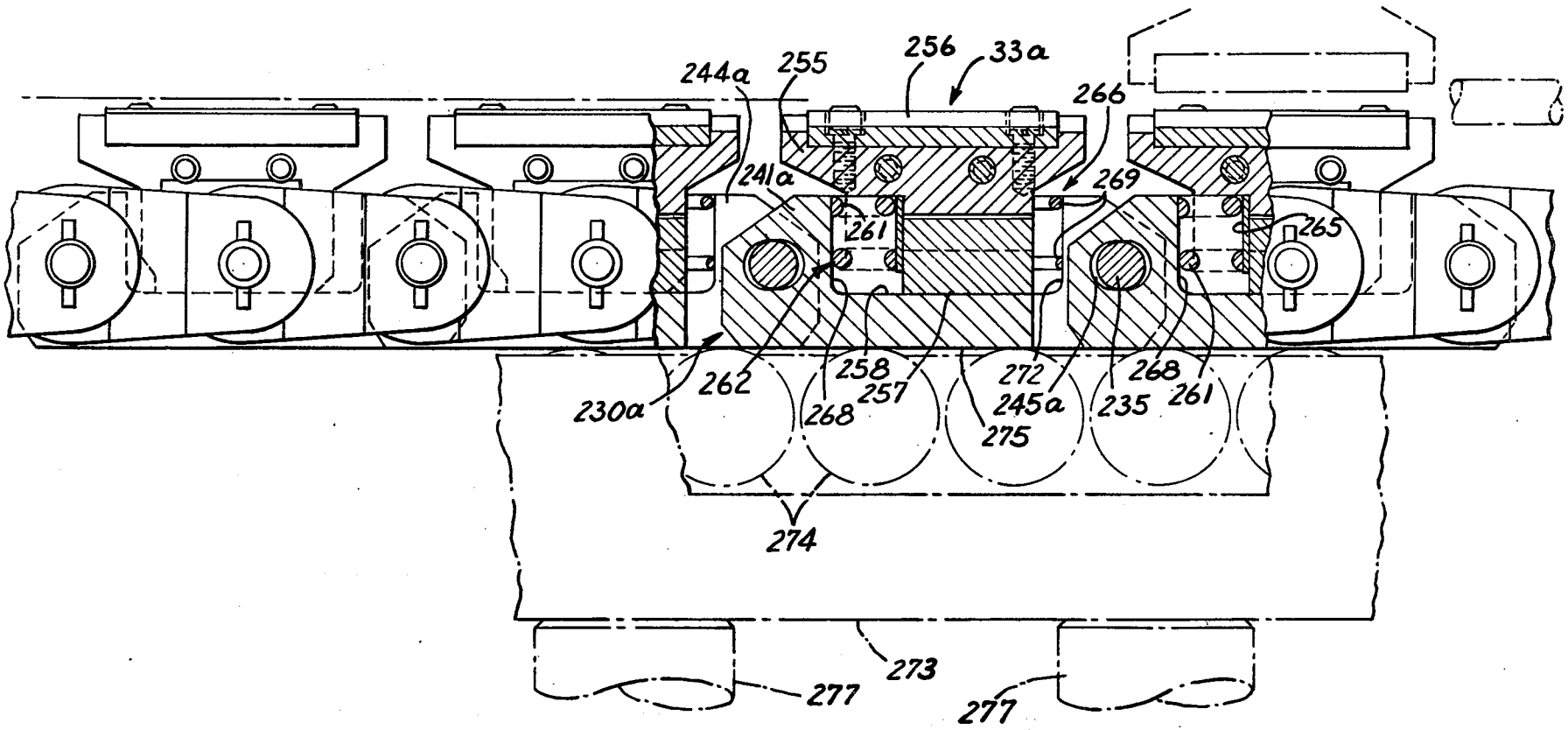
FIG. 16 is a partial elevational view, partially sectioned of the restraining elements of FIG. 15.

As in U.S. Pat. No. 3,687,380, the preferred prestressing unit 28, as best seen in FIG. 11, comprises a pair of endless bands 31, preferably in the form of endless chains 32, each carrying a series of restraining elements 33 or **33*a* thereon, as best seen in FIGS. 16 and 20. The restraining elements 33 are opposed and grip the tendon 17 therebetween and apply a restraining force to the tendon as the carriage is driven forwardly. Means in the form of load cells 35 (FIGS. 11 and 12) measure the tension applied by the tendon tensioning mechanism 28 to the tendon 17 are are used to control a hydraulic system to increase or decrease the torque being applied by a hydraulic motor pump means 37 (FIG. 2) to the endless chains 32 having the restraining elements 33 gripping the tendon 17. As will be explained, the preferred hydraulic motor pump means 37 is a portion of a regenerative system by which work developed within the tendon tensioning mechanism 28 is used to assist the traction drive means 23 to propel the carriage 19 about the structural wall 12**.

The carriage 19 is preferably supported for travel about the structure 15 by a means such as a suspension system 39 (FIG. 3) which is secured to the top of the structure 15. Alternatively, the carriage 19 may be supported or positioned for vertical displacement on a frame or suspension system which is independent of the structure 15. The illustrated suspension system 39 comprises a overhead circular track 38 in the form of an I-beam into a general circular configuration and secured at circumferentially spaced locations to the underside of overhead strut beams 41 (FIG. 5) each of which projects radially outwardly from a pair of vertical support columns 43 fastened to the top of the structure 15. The beams 41 extend outwardly of structural wall 12, as best seen in FIG. 5, to support the I-beam track 38 and carriage 19 therebeneath.

The suspension system 39 further comprises a series of trolley units 45 having wheels 47 in rolling engagement with the bottom flange of the track 38 on opposite sides of the vertically extending web of the I-beam of the track 38. Each of trolley units 45 carries a power drive hoist 49 which winds or unwinds suspension cables 51 which extend from the hoist to the carriage 19 and, in this instance, also to the restraining system 21. By adjusting the length of the suspension cables 51, the carriage 19 and the restraining system 21 may be shifted vertically. Preferably, the hoists 49 are relatively heavy duty hoists with a 15,000 pound capacity and have a 103 foot lift.

The illustrated circumferential restraining system 21 is formed of a series of truss link units 54 forming with the carriage 19 a band about the structure 15 with a series of circumferentially spaced idler wheels 55 rolling about the structural wall 12. More specifically, for the illustrated 100 foot diameter structure, eight to ten truss link units 54 are pivotally joined end to end to each other and with end ones of the truss link units 54 joined to opposite ends of the carriage 19 and propelled by the traction drive means 23 on the carriage 19.

Herein, the truss link units 54 are in the form of rigid spaced upper and lower horizontally extending bars 59 and 61 joined together by vertically extending tie bars 62. Alternating ones of the truss link units 54 have a pair of idler wheels 55 mounted at opposite ends thereof in rolling engagement with the structural wall 12. The wheels 55 are journaled for rotation about vertically extending axles 65 extending between a pair of upper and lower brackets 63 at each end of the wheeled units 54. The link units 54 are articulated to each other for pivoting about a vertical axis by a pivot means 67 preferably in the form of ball joints 68 which also are located on radial lines extending to the vertical axle of the structure. The inner sides of the link units 54 are spaced from the structural wall 12 at all times. By way of example only, the link units 54 may be approximately 30 feet in length. Also, the upper and lower sets of idler wheels 55 are spaced vertically at about 86.5 inches, in this instance, for riding on structural lands 70 on the wall 12, as best seen in FIG. 5, between a pair of adjacent grooves 71 into which are laid the tensioned tendons 17. Both the rearward and forward ends of the carriage 19 have pivotal connections to end ones of link units 54, both of these end units 54 being non-wheeled, in this instance.

Figure 6:
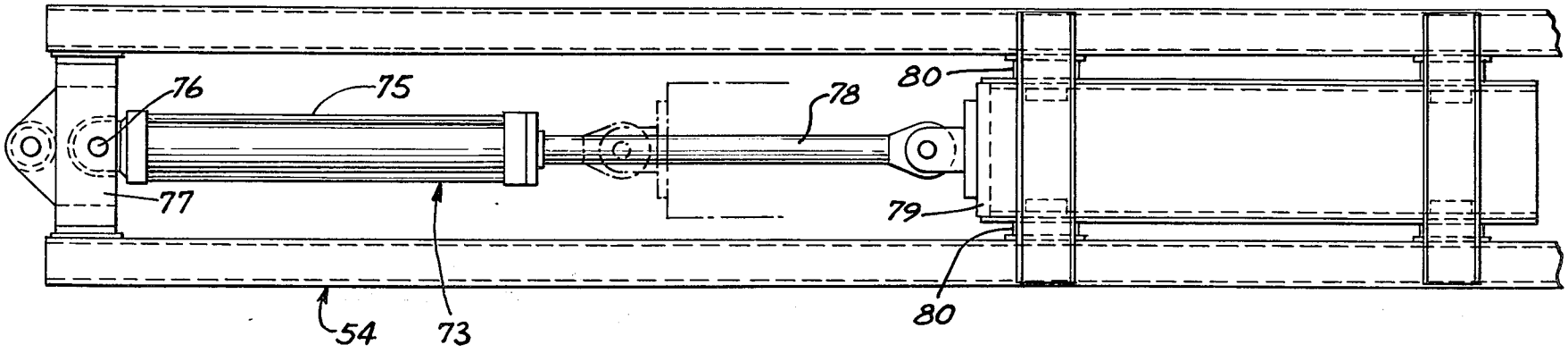
FIG. 6 is a view of a takeup means for the restraining system.
Figure 4:
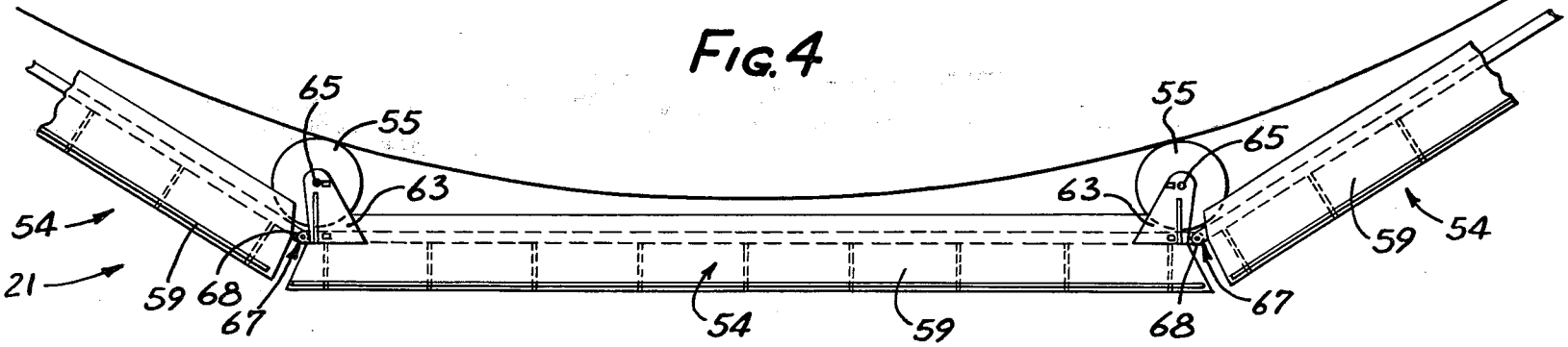
FIG. 4 is a plan view of the suspension system of FIG. 3.

The circumferential restraining system's primary function is to supply sufficient normal force, i.e., normal to the structural wall 12, to establish good traction and friction between the carriage traction drive means 23 and the structural wall 12. The preferred manner of supplying and controlling this normal force is by means of a hydraulic takeup device 73 which is carried by the link unit 54 connecting the rearward end of the carriage 19. As best seen in FIG. 6, this trailing link unit 54 has hydraulic cylinder 75 fastened at one end 76 to rigid, stationary crosspiece 77 of the link unit 54 with its ram 78 connected to a slidable tube 79 which at its opposite end carries the ball joint pivotal connection with the next link unit 54. By shifting the tube 79, which is guided for sliding by bearing pads 80, from its solid line to its dotted line position, the circumferential extent of the restraining system band is decreased by retraction of the ram 78 and this increases pressure and normal force between the traction drive means 23 and wall 12 of the structure. By way of example, the hydraulic cylinder 75 may have a 5 inches diameter bore and a 30 inches stroke. When it is desired to shift the carriage 19 and restraint system vertically, the hydraulic ram 78 is extended, as to the illustrated solid line position, to release the idler wheels 55 and the traction drive means from tight contact with the wall 12 thereby allowing vertical movement thereof by the suspension system 39.

Figure 7:
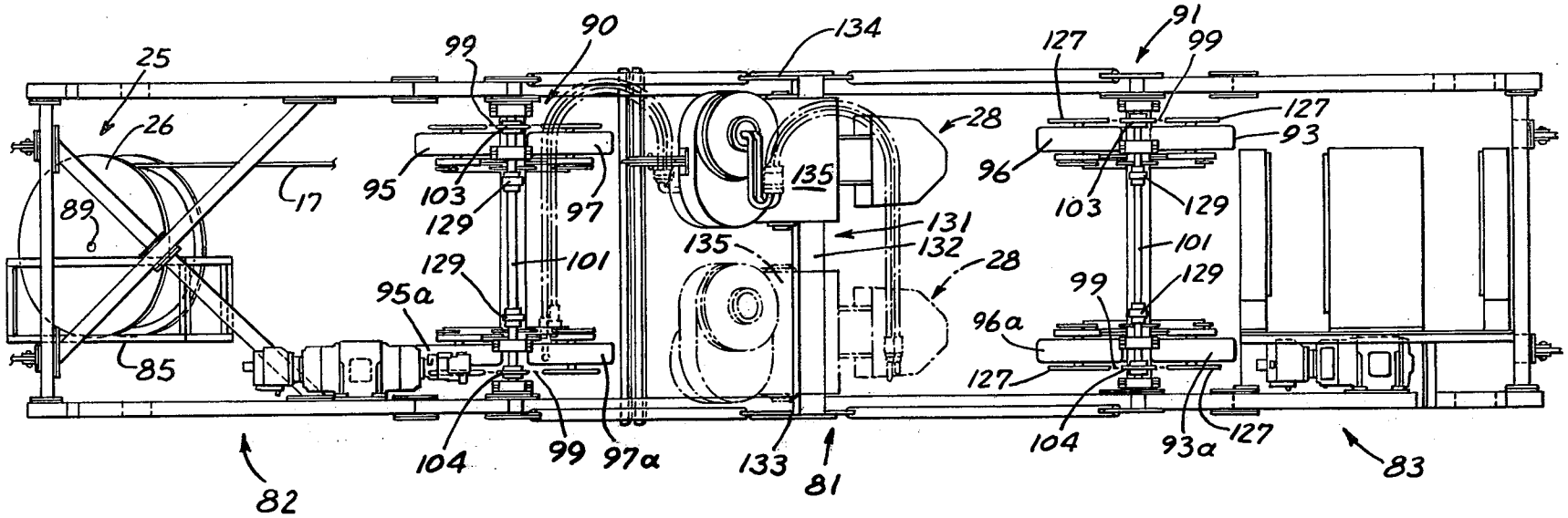
FIG. 7 is an elevational view of the apparatus illustrated in FIG. 2.

The carriage 19 is, in this instance, an elongated rigid structure with a central straight section 81 joined to an angled front section 82 and an angled rear section 83. The sections 81, 82 and 83 are formed of a tubular framework havig a rigid trusslike appearance and is one unitary structure although the carriage 19 may be constructed with the two pivotally joined units described in U.S. Pat. No. 3,687,380. As best seen in FIGS. 2 and 7, a horizontally extending plate 85 in the front section 82 of the carriage 19 carries the reel means 25 and rotatable spool 26 which turns about a horizontally extending axle 89 to pay out the tendon 17 which extends therefrom to an inlet guide roller 92 located at the inlet portion of the tendon tensioning means 27.

The traction drive means 23 for driving the carriage about the structural wall 11 and for tensioning the tendon 17 being payed out comprises a forward traction wheels set 90 and a rearward traction wheel set 91 which are mounted at opposite ends of the central section 81 of the carriage 19, as best seen in FIGS. 2 and 7. As will be explained in greater detail, outer wheels 93 and **93*a* of the rearward wheel set 91 are hydraulically interconnected with outer wheels 95 and 95*a* of the front wheel set 90 to form a primary drive for the carriage 19. Inner rear wheels 96 and 96*a* of the rearward set of wheels 91 are interconnected with front inner wheels 97 and 97*a* of the front wheel set 90 by a second or regenerative hydraulic system which includes a motivating force from a hydraulic regenerating means coupled to the tendon tensioning mechanism 28.**

For the purpose of preventing slippage of any of the wheels relative to each other, the wheels **95, 95*a* and 93, 93*a* of the primary hydraulic system are all driven by the same primary hydraulic system and are thus interconnected thereby and all of the inner wheels 96, 96*a* and 97, 97*a* are driven by the regenerative hydraulic system; and these wheels driven by these two separate hydraulic systems are interconnected mechanically by chain drives including chains 99 extending between adjacent wheel pairs and vertically extending shafts 101 mechanically coupling together the upper and lower wheel pairs. More particularly, the rear upper pair of wheels 93 and 96 are joined by an upper chain 99 and the rear lower pair of wheels 93*a* and 96*a* are joined by a lower chain 99 with a vertically extending shaft 101 having sprockets 103 and 104 each meshed with a chain 99 whereby all four rear wheels are driven at the same speed and with a transfer of torque therebetween to prevent one wheel from slipping or rotating at a speed different from that of the other wheels. In a similar manner, the pair of front upper wheels 95 and 97 are joined by an upper chain 99 which meshes with a gear 103 fastened to the upper end of shaft 101 having another lower sprocket 104 meshed with the lower chain 99 connecting the front lower wheels 95*a* and 97*a*.** Thus, all four of the front wheels are mechanically coupled to rotate at the same speed and to transfer power therebetween. Also, beacuse some of the front wheels and rear wheels are connected hydraulically, all of the wheels should rotate at the same speed and all should apply traction to shift the carriage.

Figure 8:
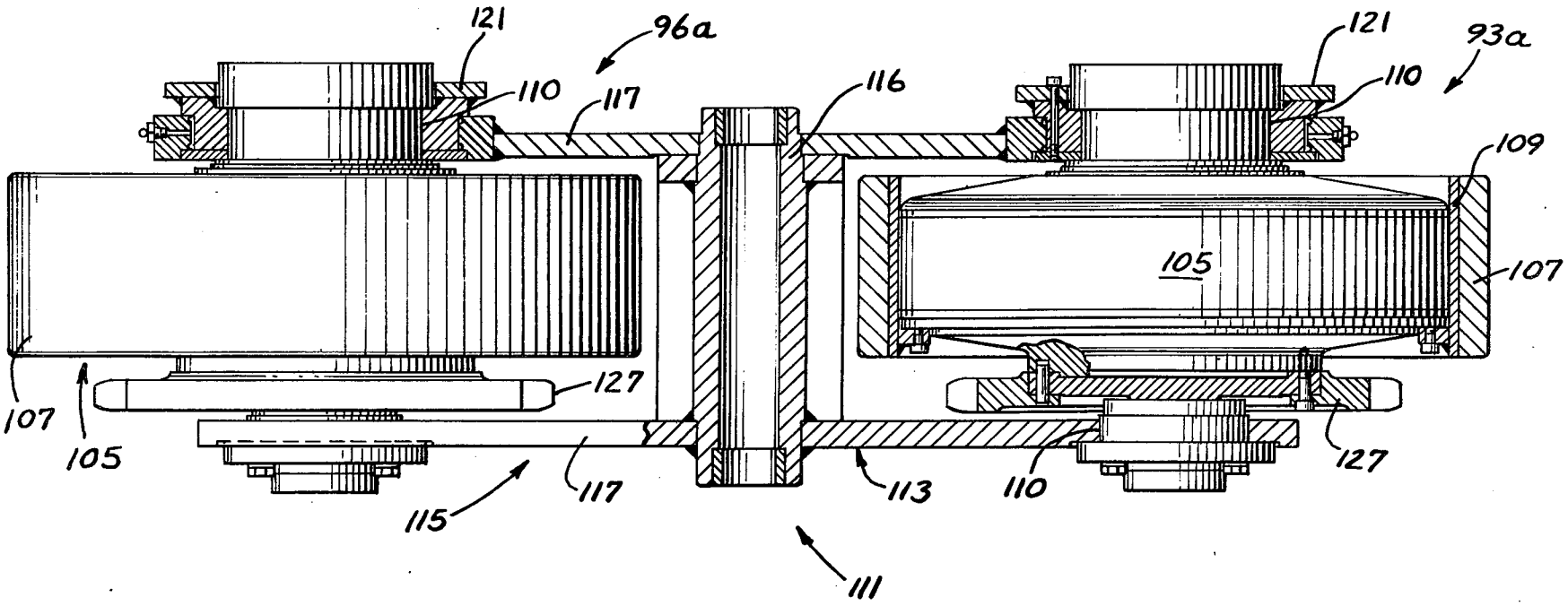
FIG. 8 is an enlarged cross-sectional view of a pair of traction drive wheels.
Figure 9:
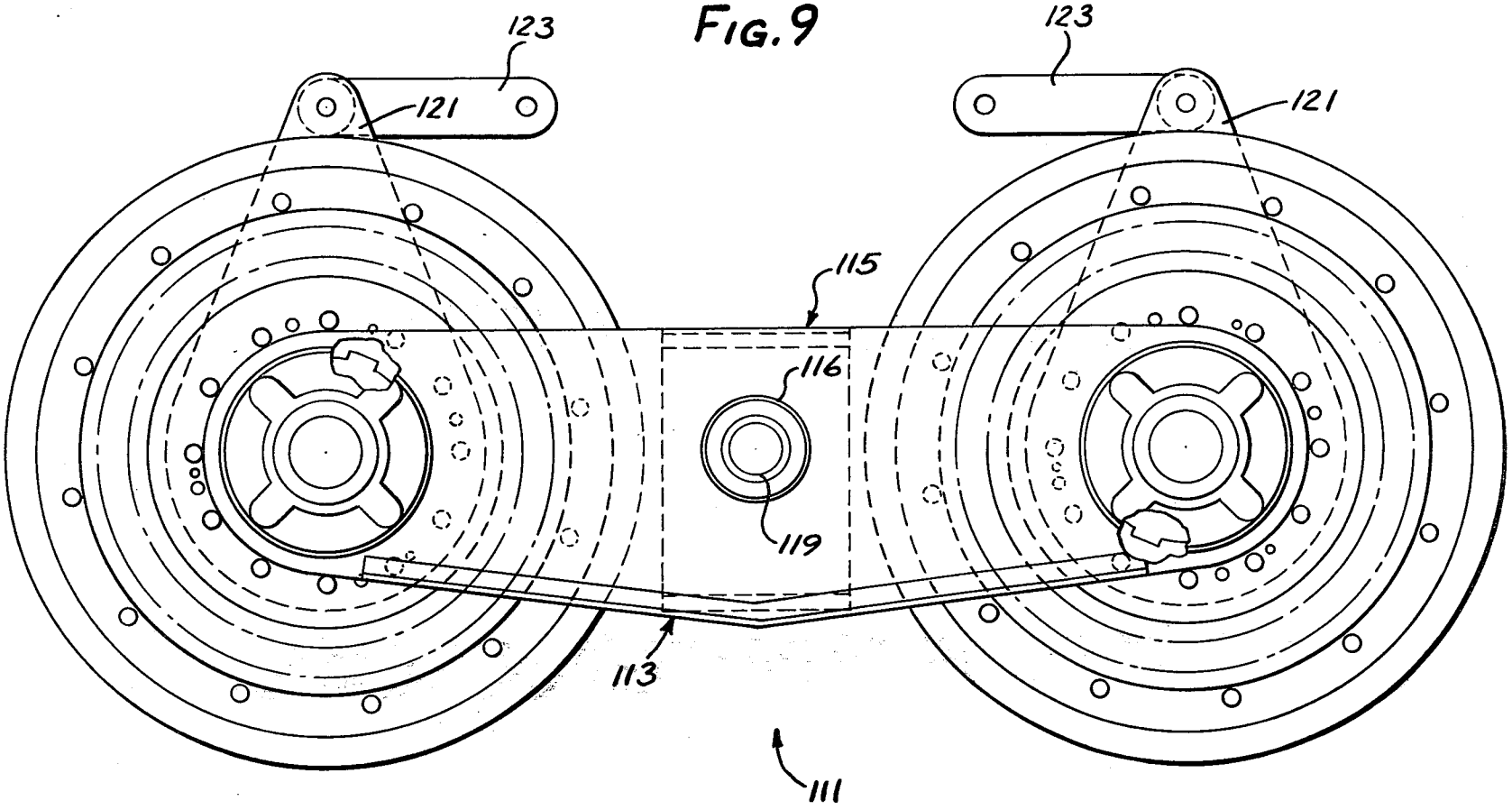
FIG. 9 is a plan view of FIG. 8.

In accordance with an important aspect of the invention, the traction drive means comprises an efficient high torque drive at a relatively low rpm for the wheels by utilizing pancakeshaped, hydraulic motors 105, as best seen in FIGS. 8 and 9, for the wheels **93, 93*a*; 95, 95*a*; 96, 96*a*; and 97, 97*a*. More specifically, these wheels are formed by securing a tire 107 of a high friction material such as urethane onto the outer rotating race or portion 109 of each hydraulic motor 105 which has a non-rotatable central portion or hub 110 by which the motors are mounted and through which hubs the hydraulic fluid is supplied to the respective pancake hydraulic motor 105. The use of hydraulic motors having low rpm, e.g., from 0 to 80** rpm and high torque eliminates the inefficiencies experienced with the use of conventional speed reducers positioned between the higher speed motors and the traction wheels or caterpillar trucks. The preferred motors are manufactured by Hagglund of ORNSKOLDSVIK Sweden; and, by way of example, operate at 1800 to 2800 psi with a flow rate of 60 to 70 gpm at 33 to 38 rpm speed.

Because each of the wheel motors 105 is mounted in a similar wheel assembly 111, a description of one wheel assembly will suffice for understanding of the other wheel assemblies. The illustrated wheel assembly 111 includes a wheel frame 113 in the form of an elongated beam arm 115 comprising a central hub 116 joined to a pair of horizontally extending upper and lower plates 117 spaced vertically to support and journal therebetween pancake wheel motors 105 for turning about vertically extending axes through opposite free ends of the arm 115. The central hub 116 of wheel frame arm 115 is mounted to a stationary support 118, as best seen in FIG. 2, of the carriage by a central bearing means located at the center of the arm 115. The central hub portions 110 of the motors 105 are held against turning about by means in the form of torque arms 121, as best seen in FIGS. 8 and 9 bolted to opposite ends of the wheel frame arm 115 with the links 123 extending from the torque arms 121 to pivot pins carried by stationary support 118 on the carriage frame.

As best seen in FIG. 8, a chain drive sprocket 127 is secured to the lower end of the rotating race 109 of each of the pancake motors 105 for the lower wheels. A pair of these sprockets 127 is meshed with a chain 99 which extends therefrom to define a generally triangular path with the sprocket 104 which is fastened at the lower end of the vertically extending shaft 101. For the upper motors, the chain drive sprockets 127 are secured to the upper end of the rotating race 109 and are meshed with the upper chain 99 to define a triangular path with the gear 103 carried by the shaft 101. Preferably, as best seen in FIG. 7, the shaft 101 is journaled at its upper and lower ends in bearings 129 carried by the stationary support 118 on the carriage 19.

Figure 10:
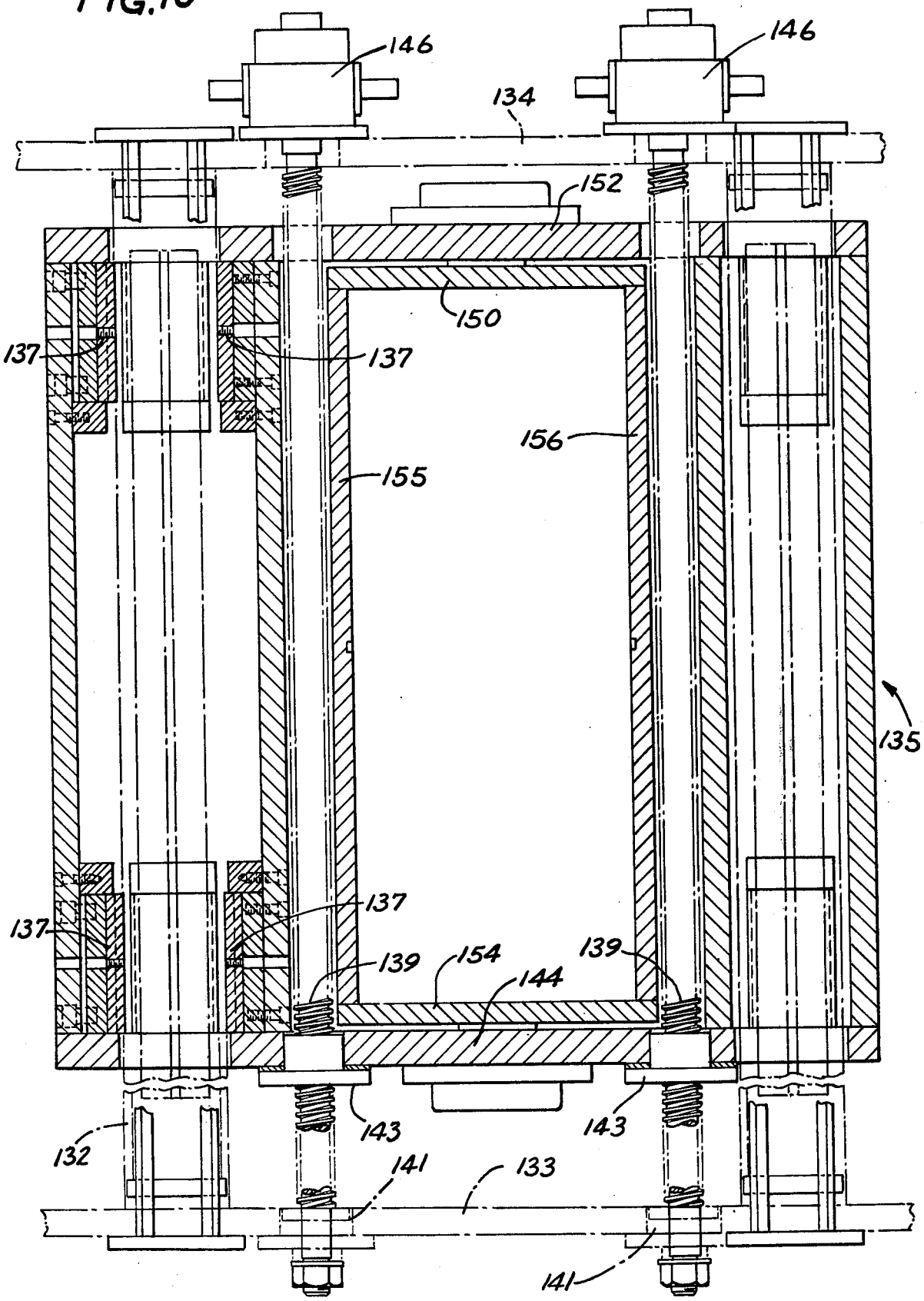
FIG. 10 is a view partially sectioned of means for shifting the tendon tensioning mechanism vertically on the carriage.
Figure 12:
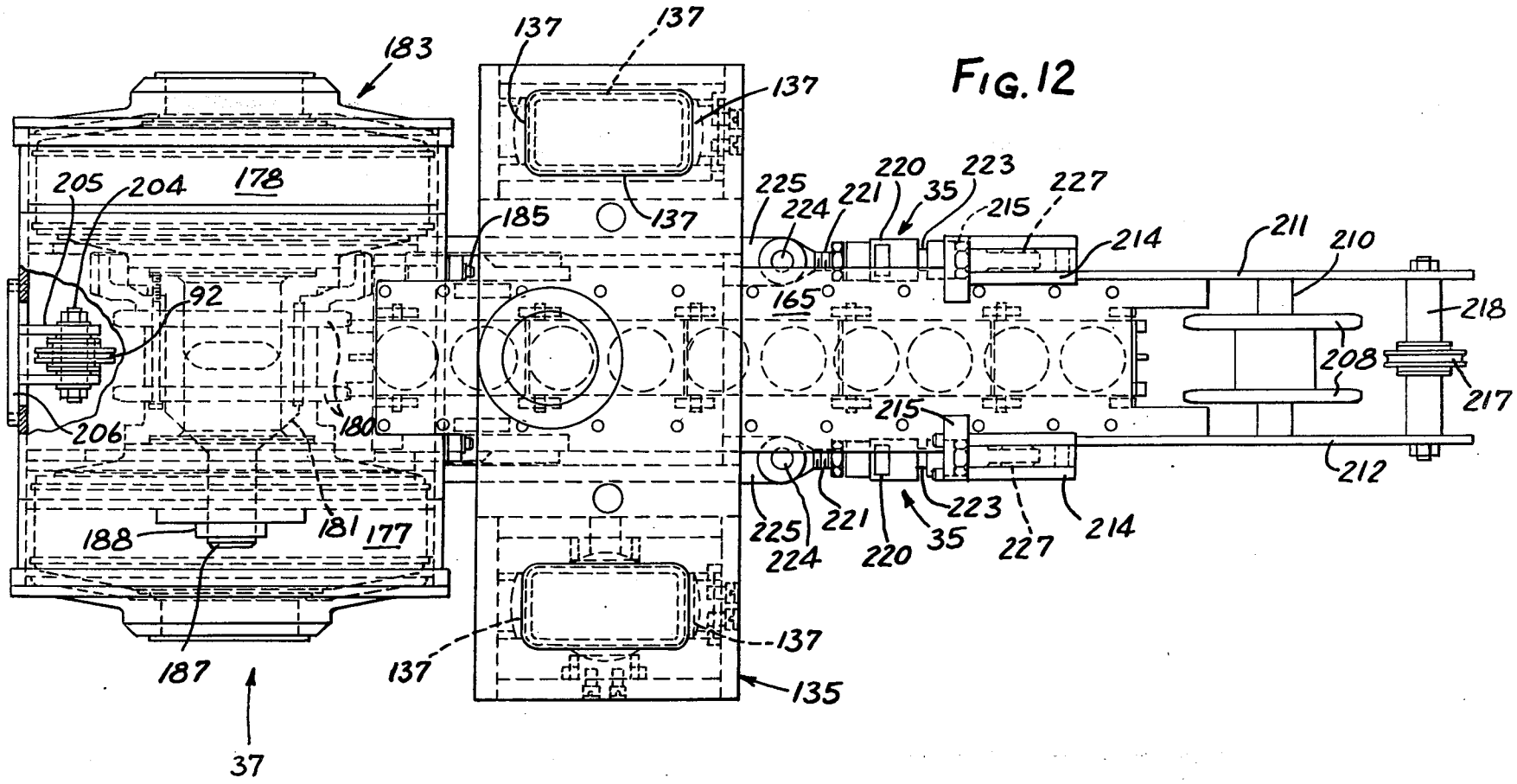
FIG. 12 is an enlarged plan view of the tendon tensioning mechanism.

With the present invention, the tendon tensioning mechanism 28 may be shifted vertically relative to the structual wall 12 without shifting the carriage 19, this being accomplished generally in the manner disclosed in U.s. Pat. No. 3,687,380, and is illustrated in FIG. 7 herein. More specifically, the tendon tensioning mechanism 28 is shiftable vertically on an upstanding stand 131, as best seen in FIGS. 2, 7 and 10, formed of a pair of upstanding standards 132 of generally rectangular cross section and bolted at their lower ends to a stationary, horizontally extending bottom plate 133 secured with the carriage and fastened at their upper ends to a horizontally extending plate 134 spanning the standards. The tendon tensioning mechanism comprises a central blockshaped slidable carrier 135 which, as best seen in FIGS. 10 and 12, has a pair of long, vertical, rectangular openings therein bounded at the tops and bottoms thereof with four slidable pads 137, each engaging one of the respective sides of the rectangular standards 132 for guiding the carrier 135 vertically relative to the carriage 19. Herein, the carrier 135 may be shifted approximately seven feet on the standards before it is necessary to shift the carriage 19 vertically with the suspension system 39.

In the manner generally similar to that disclosed in the aforementioned patent, the carrier 135 is shifted vertically on the standards 132 by means of jack screws 139 (FIG. 10) which extend vertically through openings in the carrier 135. Lower ends of the jack screws 139 are journaled in bearings 141 carried by the bottom frame plate 133. The upper end of the jack screws are journaled for turning in the top stand plate 134. Nuts 143 are fastened to a lower plate wall 144 of the carrier 135 and are threaded onto the jack screws so that with turning of the jack screws, the carrier is shifted on the standards relative to the carriage. The jack screws are each turned by hydraulic motor 146, which are mounted on the top stand plate 134 and secured to the upper ends of a jack screw.

In addition to the tendon tensioning mechanism 28 being swingable about a vertical axis through the articulating means 29 to ensure the in line tangential path for the tendon 17 to the wall 12 of the structure, the tendon tensioning mechanism 28 is also swingable about a horizontal axis to eliminate a slight bend, e.g., less than one degree, found to exist when provision was not made to accommodate turning about a horizontal axis. This bend may occur at the discharge end of the prestressing unit as the stretched tendon 17 passes between a pair of discharge rollers 217 to a tightly packed position adjacent one of the walls of the groove receiving the tensioned tendons therein. It has been found that with the tendon 17 stressed to, e.g., 30,000 lbs. for a 0.5 inch diameter tendon, which is about 75% of its yield strength, that even a half degree bend should be eliminated as it may further stress the tendon close to or above its yield point.

In accordance with an important aspect of the invention, the tendon tensioning mechanism 28 is pivoted with a generally gimbal type of arrangement near its center of gravity to permit a limited, for example, one and a half degree tilt in the vertical direction about a horizontal axis and a five degree swing in the horizontal direction about a vertical axis intersecting the horizontal axis.

The articulating means 29 for allowing swinging about the vertical axis comprises a pair of stub shafts 148 and 149 (generally as described in the aforementioned U.S. Pat. No. 3,687,380) to assure that the tendon 17 automatically swings into a line tangentially to the wall of the structure. The stub shafts 148 and 149 are located on a vertical axis passing through the tendon 17 and located midway between upstanding standards 132. The stub shafts 148 and 149, as best seen in FIG. 11, have outer ends journaled in bearings 151 carried by the upper horizontal carrier plate 152 and the lower horizontal carrier plate 144, respectively. The inner ends of the stub shafts 148 and 149 are fastened to upper and lower horizontal plates 150 and 154, respectively; and the latter joined at opposite ends to a pair of parallel vertical carrier plates 155 and 156 to define a hollow box-like structure, as best seen in FIGS. 10 and 11. The box-like structure of the carrier carries the internal bearing means 158 which allows longitudinal movement of the prestressing unit 28 and a slight tilting thereof about a horizontal axis to provide the fleet angle.

Figure 13:
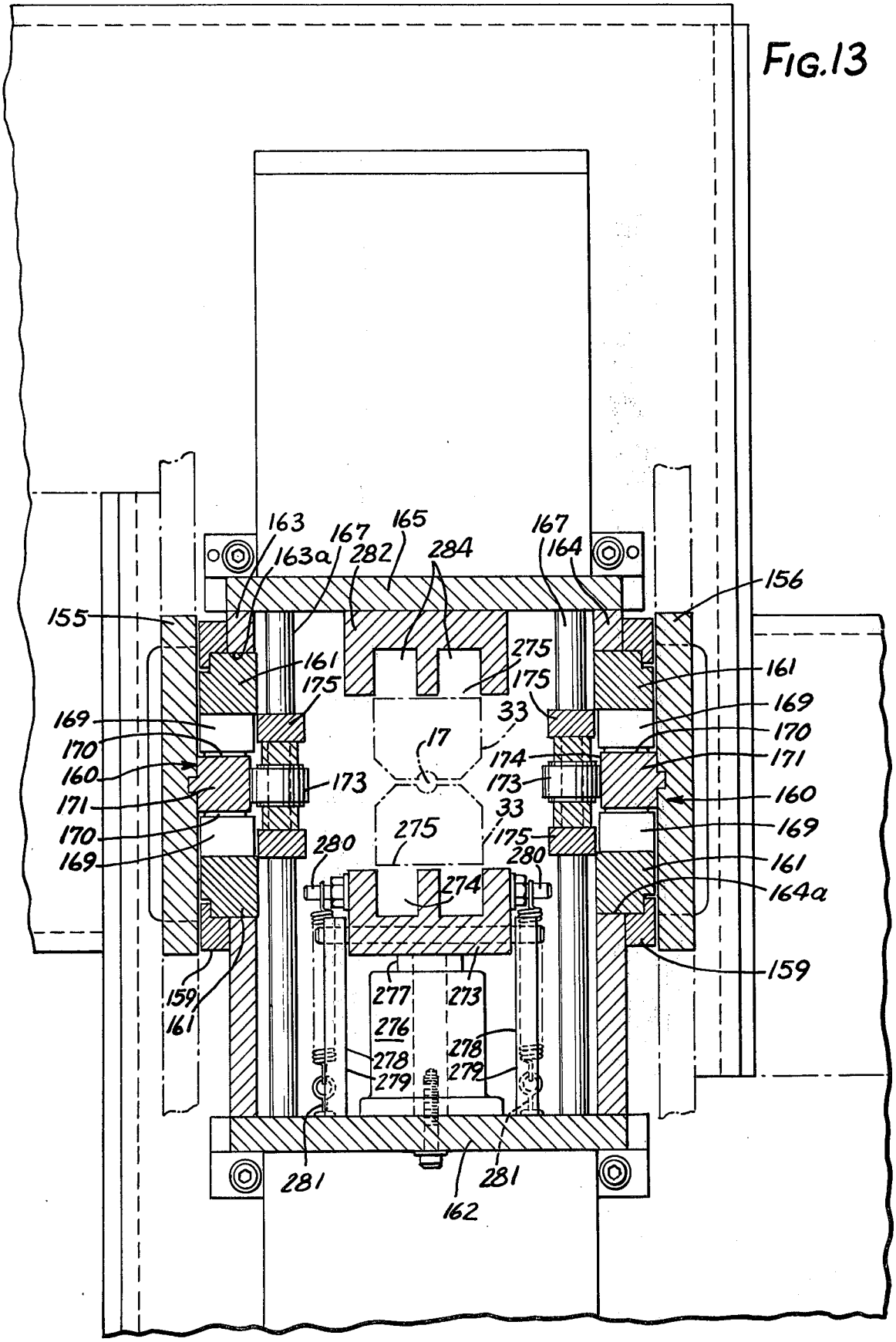
FIG. 13 is an enlarged sectional view of the bearing mounting of the tendon tensioning mechanism.

As best seen in FIGS. 11 and 13, a preferred bearing means 158 includes a pair of opposed linear bearings 160 each of which is carried by one of the upstanding carrier plates 155 and 156 of the carrier 135 and supports the stressing mechanism for longitudinal sliding movement relative to the carrier. More specifically, the linear bearings 160 are mounted within circular housings 161 which are mounted within circular openings in vertical stress head plates 163 and 164 fastened to the upper and lower stress head plates 162 and 165 to define a stressing head frame. The latter also includes a series of vertically extending tie rods 167 fastened to the upper and lower stress head plates 162 and 165.

Each of the linear bearings 160 includes an upper and lower series of horizontally extending rollers 169 (FIGS. 11 and 13) mounted in the circular housing 161 for abutting and rolling along the upper and lower flat walls 170 of horizontally extending bars 171 which are machined and secured to the respective carrier plates 155 and 156. The preferred linear bearings are commercially available from Scully-Jones Corporation of Downers Grove, Illinois. As the bearings 169 roll on the upper and lower flat walls 170 of the bars 171 and relative to the carrier vertical plates 155 and 156, the stress head frame may shift in the longitudinal direction under pull of the tendon or the release of a tendon subsequent to prestressing operation.

The rocking movement of the prestressing unit 28 about a horizontal axis to provide the fleet angle is through the center axis of the circular housings 161 for the linear bearings 160 with circular surfaces 163*a* and 164*a* in the stress head plates 163 and 164 turning about the outer circumferential surfaces of the circular housings 161. In operation, a vertically directed force from the tension 17 on the outer free end of the stressing head frame causes its stressing head plates 163 and 164 to turn their surfaces 163*a* and 164*a* about the outer circular surfaces of the bearing housings 161. The latter are held against turning with the stressing head frame by the rows of bearings 169 engaging the horizontal bars 171 fastened to the carrier. The circular housings 161 are retained within the circular openings in the stressing head plates 163 and 164 by outer encircling annular flanged retainers 159 secured to the stress head plates 163 and 164 and by a pair of inner horizontal bars 175, as will be explained.

In accordance with an important aspect of the invention, the frictional forces encountered in longitudinal sliding of the stressing head frame in the bearings means 158 have been reduced by positioning the motor pumps 177 and 178 to counter balance the weight of the long forward end of the stressing head. That is, the weight of the forward end of the prestressing unit 28 from which the tendon 17 passes to the wall 12 is offset by positioning the hydraulic pump means 37 including a pair of hydraulic motors 105 acting as pumps 177 and 178 rearwardly of the bearings means 158 and the standards 132 supporting the bearings means 132. In the prior art device, the actual tension in the tendon 17 differs from the tension force reading of the load cells because of frictional forces between the stressing head frame and its supporting bearings and because of any wedging action between the stressing head and the bearings due to a bouncing of the carriage in its travels. Counterbalancing the weight and the use of the linear bearings provides more accurate tension readings from the load cells of the present invention than experienced with the patented apparatus.

Figure 14:
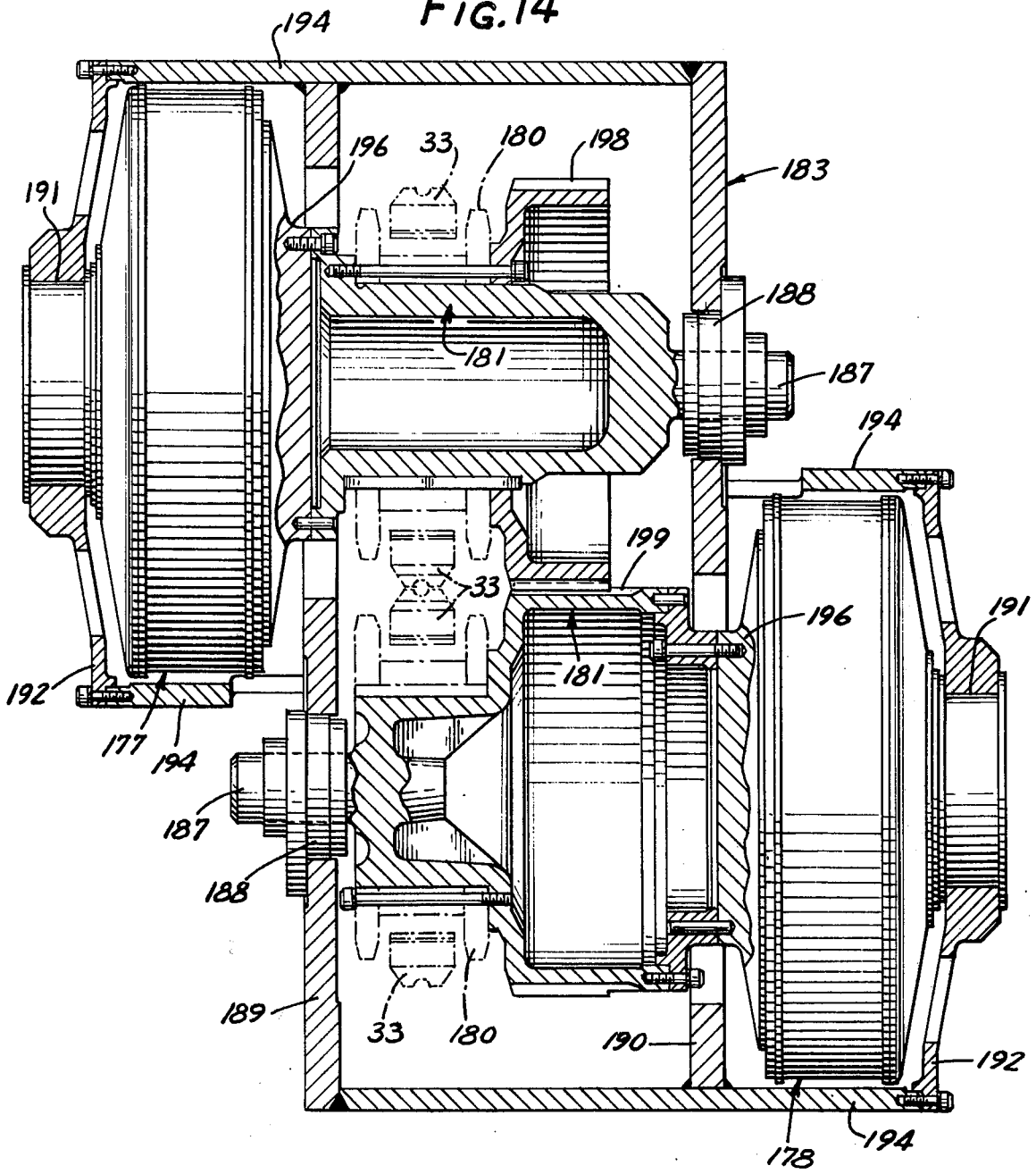
FIG. 14 is an enlarged partially sectional view of the hydraulic pumps used in tensioning the tendon.

As best seen in FIGS. 11, 12 and 14, the hydraulic means also includes double drive sprocket 180 fastened to hub extensions 181 of the pumps 177 and 178 for driving the endless bands 31 and restraining elements 33 carried thereon. Herein, the respective motor pumps 177 and 178 are supported in a housing 183 which is bolted by bolts 185, as best seen in FIGS. 11 and 12, to the rear ends of the supporting plates 162 and 165 of the prestressing unit 28. Thus, the pumps 177 and 178 are carried by the stressing head frame and may slide longitudinally and pivot therewith.

Referring in greater detail to the drive of the endless bands 31, the hub extension 181 of the motor pumps 177 and 178 terminate in narrow shaft portions 187 mounted in bearings 188 carried by vertical walls 189 and 190 of the housing 183. The outer and opposite hub ends of the motors 177 and 178 are journaled in bearings 191 carried by stationary, circular plates 192 which are secured at their outer peripheral edges to annular collars 194 which are secured to the stationary housing walls 189 and 190. The rotating outer race portions 196 of the motor pumps 177 and 178 have secured thereto the inwardly projecting hub extensions 181. The upper hub extension 181 supports a sprocket 180 and a synchronizing gear 198 which is keyed and bolted thereto to rotate therewith. The lower hub extension 181 has gear teeth 199 integrally formed thereon for meshing with the teeth of the gear teeth 198 to maintain the upper and lower hydraulic pumps 177 and 178 and their double sprockets 180 in synchronism. Thus, the pumps 177 and 178 will share the load and turn at the same speed. The restraining elements 33 return on the top run thereof and are brought together by the sprockets 180 to engage and grip the tendon 17 for tensioning the same along a bottom run.

As best seen in FIGS. 11 and 12, the tendon 17 is guided to a position between the upper and lower restraining elements 33 by the pair of grooved guide rollers 92 mounted on horizontally extending axles 204 carried by a bracket 205 and formed with an aperture in its rear plate 206 through which the tendon 17 passes into groove between the guide rollers 92 and to the restraining elements 33 for tensioning thereby.

The endless bands 31 extend through the central opening in the prestressing unit 28 from the pair of inlet sprockets 180 to the pair of outlet double sprockets 208 and 209 which are mounted on horizontally extending axles 210 journaled to rotate a pair of wedge-shaped plates 211 and 212, which are fastened to triangular-shaped plates 214, as best seen in FIG. 11, bolted to blocks 215 by bolts 216. The blocks 215 are secured to the longitudinally extending upper and lower plates 162 and 165 of the stressing head frame.

At the outlet end of the stressing unit 28 is a pair of outlet guide pulleys 217 each mounted on a horizontally extending shaft 218 spanning the wedge-shaped plates 211 and 212. The pulleys have grooves therein through which pass the tensioning tendon 17 to the structural wall 12. The slight fleet angle bending, which heretofore occurred, was caused by the tendon bending slightly downward on the pulleys 217 when the tendon was being tightly pcked in the groove. Herein, a downward force on pulleys from the tendon will pivot the stressing head frame without creating the undesirable bend in the tendon.

The load cell means 35 is positioned between the longitudinally restrained carrier 135 and longitudinally shiftable prestressing unit 28 which is mounted in a manner to reduce the effect of frictional forces and bending loads which are the sources of error in accurate readings by the load celll means 35 of the tension being undergone by the tendon 17. To this end, the load cell means 35 comprises a pair of load cells 220, FIGS. 11 and 12, which are mounted between a pair of tension link members 221 and 223 which, in turn, are pivotally connected to the carrier 135 and the prestressing unit 28, respectively. The link 221 is pivotally mounted on a vertically extending pin 224 carried in bracket 225 fastened to the carrier 135. The link 223 is pivotally mounted to a ball connection 227 mounted in the bracket 214 with the tension link member 223 pivotal about a horizontal axis through the ball 227. Preferably, the tension link members 221 and 223 are made adjustable in length so that the lengths of the tension link members may be changed. With the turning movement of the tension only and unaffected by bending loads caused by the pivoting or bounding of the prestressing unit 28, the load cells 35 will reflect more accurately the tension in the tendon 17. The load cells 35 measure tension irrespective of the direction of travel of the carriage when either paying out or taking up cable.

In the tendon tensioning means 27, a tendon 17 is stressed while continuously moving therethrough by means of the traveling restraining elements 33, which define a straight line pathway for the tendon. The amount of restraint applied by the restraint elements 33 to the tendon 17 determines the degree to which the tendon is prestressed and also the degree of its elongation. The restraining elements 33 simultaneously engage the top and bottom surfaces of the tendon and have outer grooved surfaces 229, FIG. 20, on vertically disposed blocks 230 which span and are carried by the pair of chains 32. Preferably, the restraining blocks 230 are attached to the chains 32 by elongated pins 235, FIGS. 15 and 20, which span the chains 32 and extend between or through openings in the blocks 230. These long holding pins 235 alternate with short chain pins 237 which serve with the long pins 235 to fasten respective chain links 238 of the given chain 32. Suitable chain rollers 239 are mounted for rotation on each of the respective long pins 235 and the short chain pins 237 between the chain links 238 in a familiar and conventional manner.

Figure 15:
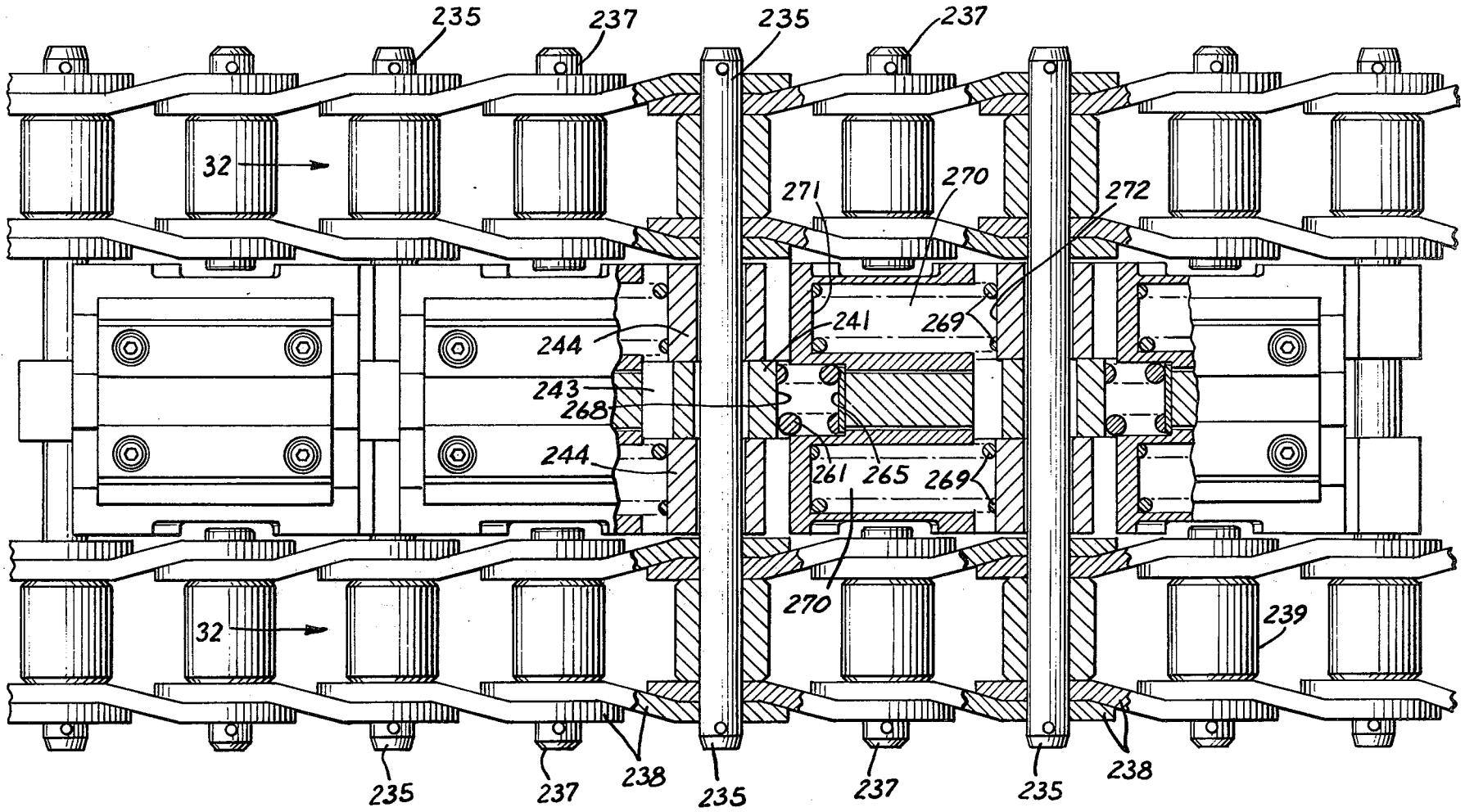
FIG. 15 is a plan view partially in section with a series of restraining elements constructed in accordance with a further embodiment of the invention for tensioning a tendon.
Figure 18:
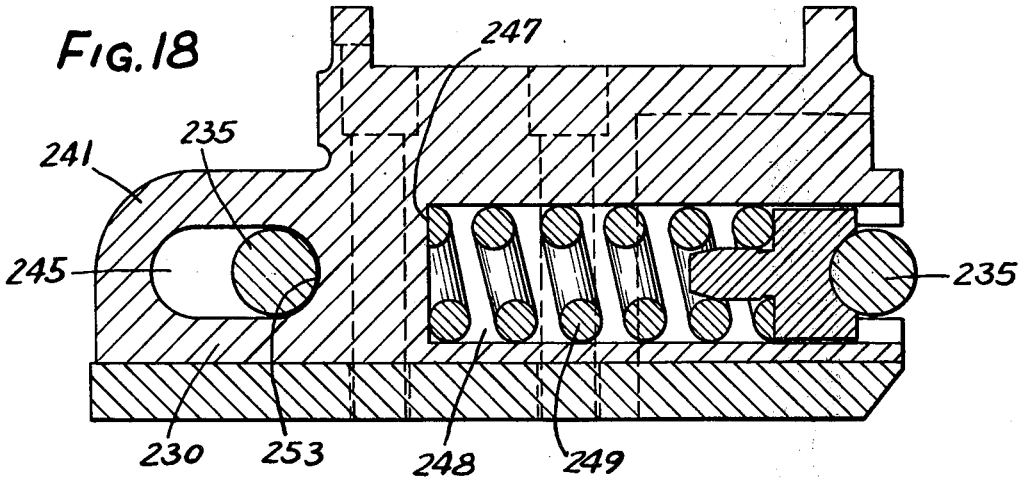
FIGS. 18 and 19 are cross-sectional views of a tendon restraining element.
Figure 19:
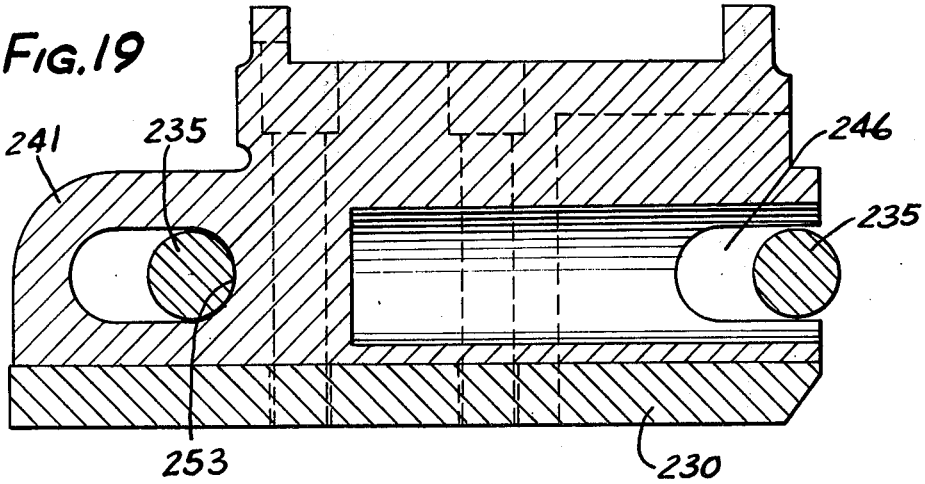

The restraining elements 33 are mounted on the chains 32 in a manner permitting the tendon engaging surfaces 229 thereon to move relative to the chains 32 to accommodate elongation of the tendon 17 as it is being stretched and being taken from substantially zero tension to full tension without the tendon engaging surfaces 229 slipping on the tendon 17 during such tensioning and elongation of the tendon 17. As disclosed in U.S. Pat. No. 3,687,380, each of the restraining elements 33 is preferably interconnected with its preceding and succeeding restraining element 33 by means of a centrally disposed rearwardly extending integral tongue 241 thereon, as best seen in FIGS. 15 and 18, which extends into a space 243 (FIG. 15) between integral yoke portions 244 at the front end of the following restraining element 33. The integral tongue 241 for each restraining block may be formed with an elongated slot 245 therein, as shown in FIG. 18, through which the long pin 235 extends to permit relative movement of the block 230 relative to the long pin 235 extending therethrough to the pair of chains 32. Elongate openings 246 (FIG. 19) also are formed in the yoke portions 244 to receive the same elongated pin 235 extending through the tongue positioned between the yokes. The elongated slots 245 and openings 246 permit movement of each restraining block 230 relative to the chains 32 when the tendon is being tensioned and being released.

As disclosed in U.S. Pat. No. 3,687,380, springs 249 (FIG. 18) may be positioned between each pin 235 and a rear wall 247 of a spring-receiving cavity 248 in its restraining block 230. As the tendon elongates, its shifts the restraining blocks 230 to the right, as viewed in FIG. 18, and compresses the spring 249 between the rear wall 247 on the block and a spring retainer 251 carried by the long pin 235. With release of the tendon 17, the compressed spring 249 expands to return the restraining block 230 to the left and to the position shown in FIG. 18, causing the end wall 253 on the block to bang against the long pin 235. The restraining blocks 230 are cast; and, it was found in practice, that there was as much as ⅛ inch variation in the depth of the length of the spring cavity 248 between its rear wall 247 and the adjacent long pin 235. As a result of the deviations in the cavity lengths, some of the restraint elements could shift with their springs taking little load while other springs 249 were taking the maximum load and bottoming out. Thus, the load was not equalized and spread in a uniform manner in the aforementioned patented apparatus.

However, with the present invention the load is shared more equally by all of the restraining elements 33 in contact with the tendon and by their springs 249. In accordance with the present invention, as will be described in connection with FIGS. 17, 19 and 19, the length of each spring receiving cavity 248 in each restraining block 230 was measured. The free length of the springs 249 and their spring retainers 251 were known to be a relatively constant length. Sufficient shims 252 were added, when necessary, to the spring 249 to provide a 0.125 inch displacement thereof when the assembly of shims 252, spring 249 and retainer 251 were placed in the cavity 248 which previously had been measured. Thus, each spring was displaced an equal amount irrespective of the size of its cavity as the shims were varied to assure the equal spring displacement. Herein, the spring displacement of 0.125 inch is equivalent to 500 pounds preloading per spring. As there are two springs 249 in each restraining block, see FIGS. 15 and 20, and, as an opposed pair of tendon restraining elements 33 act on the same area of the tendon 17, the four springs 249 for a pair of opposed blocks provide an accumulated force of 2,000 pounds of preloading for each pair of opposed restraining elements. In this illustrated embodiment of the invention, the loading of each restraining element 33 is usually increased to about 4,000 pounds at full load and full tensioning of the tendon 17.

One particular problem encountered with the release of the restraining blocks 230 from the tendon 17 and the rapid return thereof was that the restraining blocks 230 snapped forward rapidly as the springs 249 expanded, causing the end walls 253 at the ends of the elongaed tongue slots 245 to bang against the elongated pins 235. As a result, the pins 235 broke with extended usage of the apparatus; and the loud banging noise caused by the banging of the restraining blocks against the pins 235 under high loads, for example, under 4,000 pounds, was most objectionable.

Figure 17:
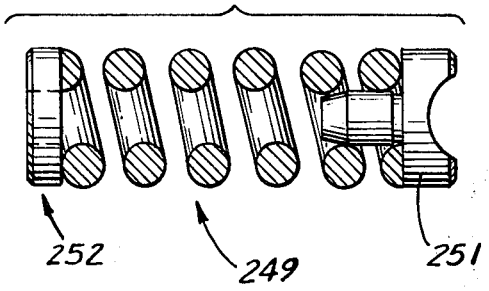
FIG. 17 is a view of a tuned spring for use with a tendon tensioning restraining element.

Although the tuned spring means 249 shown in FIG. 17 with the shims 252 resulted in more uniform loading and lower loads for the restraining blocks 230, it is preferred to employ another means to accommodate tendon elongation and shifting of the restraining elements relative to the chains 32. Similar reference characters with the suffix *a* added will be used to describe elements heretofore identified with the same reference characters. More specifically, and as will be explained in connection with FIGS. 15 and 16, restraining elements **33*a* are formed with an inner restraining block 230*a* and an outer slideable gripper block 255 having differential friction surfaces 256 and 257 which permit the gripper block 255 to slide on its restraining block 230*a* as the tendon 17 elongates without the tendon engaging friction surface slipping on the tendon surface. More specifically, the tendon engaging friction surface 256 is a soft metallic high friction surface which will not readily slide on the tendon surface whereas the frictional surface 257 is a low friction surface of a dissimilar metal and slides on abutted frictional surface 258 on the restraining block 230*a* with tendon elongation. The sliding of the frictional surface 257 and the gripper block 255 accommodates the tendon elongation while allowing the block 230***a* carrying the pins 235 to remain at a relatively fixed location relative to long pins 235 which pass through holes 245*a* in tongues 241 in tongues 241*a* and through openings in the yokes 244*a*. Preferably, the low frictional surfaces 257 and 258 are hardened and polished metallic surfaces.

For the purpose of loading the restraint blocks 230*a* and for reducing the banging noise as the gripper blocks are released from the tendon, the restraining elements 33*a* further comprise a first spring means 262 which is compressed during elongation of the tendon 17 and a second spring means 266 which absorbs the energy during release and return of the gripper blocks 255 under the expansion of the first spring means 262. That is, the second spring means acts to absorb the return force of the released restraining blocks 230*a* to prevent the banging noise and the damage to the gripper blocks 255 to the restraining blocks 230*a* or to the supporting pins 235*a*. Herein, the fist spring means 262 comprises stronger coiled springs 261 inserted between vertical end wall 265 of the gripper blocks 255 and vertical end wall 268 of the restraining block 230*a*, the second spring means 266 comprises a pair of small coiled springs 269 in spring receiving grooves 270 in the restraining block 230*a*. The springs 269 extend between end walls 271 (FIG. 15) of the grooves 270 and walls 272 on the restraint blocks 230*a*.

For the purpose of tightly gripping the tendon 17 between the restraining elements 33 and to prevent slipping between the tendon and the restraining elements, the latter are forced tightly against the tendon by means comprising a movable lower backup plate 273 (FIGS. 13 and 16) having rollers 274 thereon which support the outer walls 275 of the lower set restrainng elements 33 on the lower chain 32. Herein, the lower backup plate 273 is urged by a series of hydraulic cylinders or jacks 276 fastened at their lower ends to the stressing head bottom plate 162, as best seen in FIG. 13, with upstanding rams 277 abutting the underside of the backup plate 273. The backup plate is urged tightly against the rams by a biasing means 278 comprising pairs of elongated vertically extending tensile springs 279 hooked at their upper ends on opposite sides of the backup plate to pins 280 projecting outwardly of the backup plate. The lower ends of the springs 279 are hooked to spring retainers 281 connected to the bottom stressing plate 162. An upper backup plate 282 also carries a series of roller 284 for abutting the outer wall 275 of the restraining elements on the upper chain 32. The rollers 284 and 274 provide reduced friction surfaces through which sufficient normally directed force may be imparted to the restraining elements 33 or 33*a* to grip the tendon 17 tightly and to apply a restraining force of about 30,000 pounds, in this instance, without sliding of tendon surface relative to surfaces 229 orr 256 on the restraining elements 33 or 33*a*. The tie rods 167 serve to hold the stressing head plates 162 and 165 against the reaction forces being exerted thereon by the hydraulic cylinders 276.

In the embodiment of the invention shown in FIG. 16, the normal force applied by the hydraulic cylinders 276 to the restraining elements 33*a* is transmitted through low friction surfaces 257 and 258 on the restraint blocks and gripper blocks 255 and to the gripper block surface 256 engaging the tendon 17. Thus, the normal force produces a first friction force between the block surfaces 257 and 258 and a second frictional force between the tendon 17 and the gripper surface 256. Because of these two distinct differential frictional forces with the same normal force, it is possible to have the surfaces 257 and 258 slip before the gripper block surface 256 slips on the tendon. Preferably, the normal force is adjusted so that the friction force between the surfaces 257 and 258 will be sufficient to just tension the tendon 17; and the additional force caused by the strand stretching will cause the surfaces 257 and 258 to slip relative to each other.

In accordance with another important aspect of the invention, the hydraulic system used herein is of the fixed displacement kind as contrasted to variable displacement kind used for apparatus disclosed in the aforesaid patent. The variable displacement, constant pressure hydraulic system was particularly susceptible to varying the tension force in the tendon with variations in travel speed of the carriage. On the other hand, with the fixed displacement and variable pressure system, changes may be made rapidly to the hydraulic pressure in the system to maintain the same tendon tension with changes in speed of the carriage. Changes in speed of the carriage 19 may result in hydraulic pressure changes as much as 400 psi in the system. As will be explained, the primary drive hydraulic system is a higher pressure system than the regenerative drive system; but the interconnecting means including the chains 99 couple the wheels of the two systems together to prevent slippage of the wheels of one system relative to the wheels of the other system.

Figure 21:
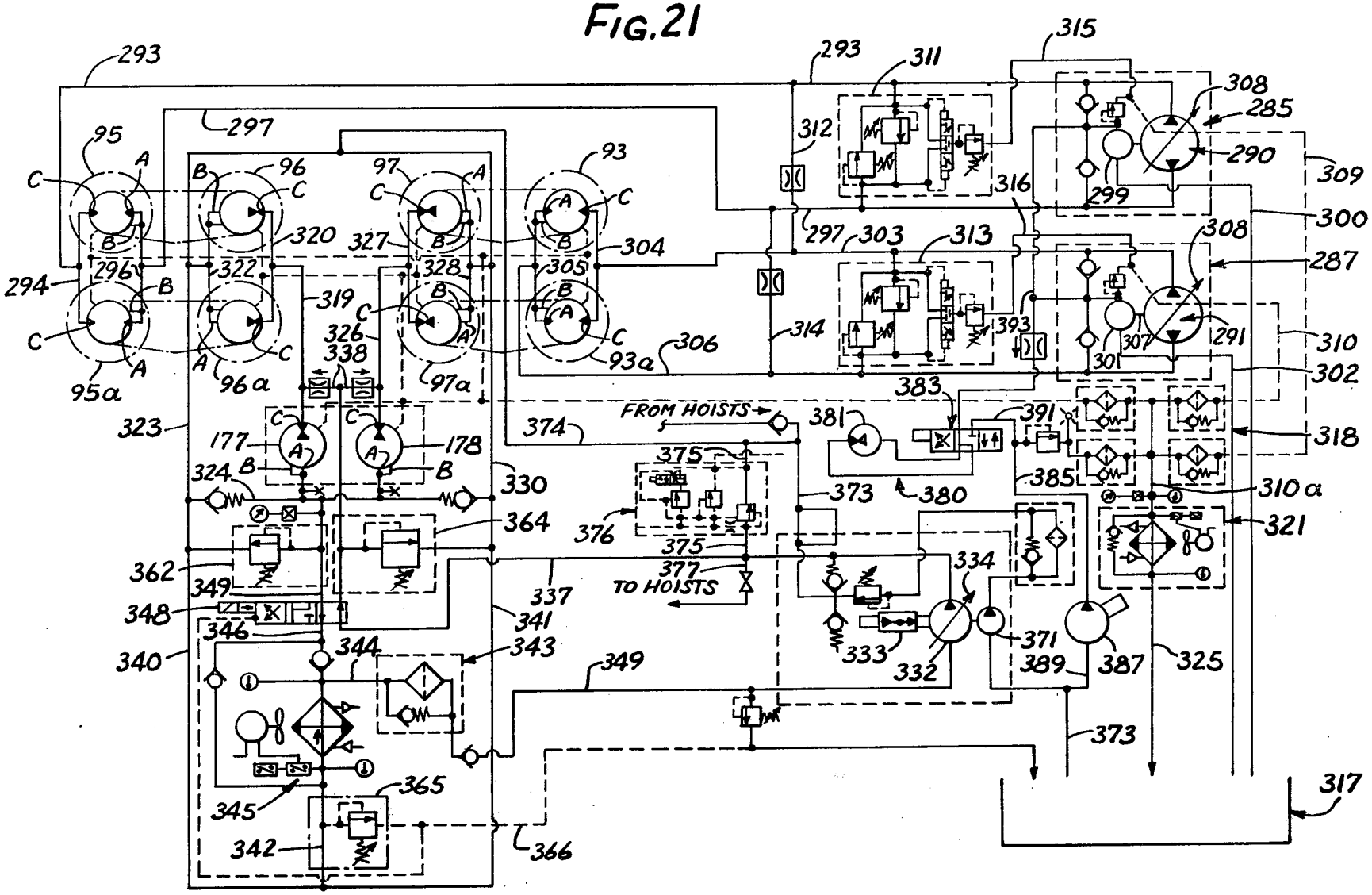
FIG. 21 is a diagrammatic illustration of the hydraulic system used in the preferred embodiment of the invention.

Referring now more particularly to FIG. 21, the primary system is a closed loop system which includes a first pump means 285 indicated by a dotted line and a second pump means 287 indicated by dotted lines in FIG. 21. Each of these pump means includes a high pressure pump 290 and 291 which supply fluid at about 2,000 psi, in this instance for driving the motors for the set of outer wheels 93, 93a and 95 and 95a. More specifically, as best seen in FIG. 21, the illustrated hydraulic pum 290 provides, when driven in the forward direction through its outlet pressurized fluid over line 293 to common inlet line 294 connected to ports C of the motors for the respective wheels 95 and 95*a*. When these motors are driven in the forward direction, the outlet fluid from their ports A flows through common line 296 to return line 297 extending to the primary hydraulic pump 290. On the other hand, when driving in reverse, the hydraulic fluid is driven in the reverse direction by the pump 290 to enter the motors for the wheels 95 and 95a to another port B and to leave via the ports C. The illustrated pump means 285 also includes a supercharge pump 299, which is supplied with and is a portion of the commercially available pump package, as will be explained. The supercharge pump supplies makeup hydraulic fluid over a line to the primary pumpp 290. The supercharge pump 299 receives makeup fluid from a line 300 extending to the common hydraulic fluid reservoir 317.

In a similar manner to that described above for the primary hydraulic motor 290, the primary hydraulic pump 291 is connected by line 303 and a common line 304 to inlet ports C of the motors for the wheels 93 and 93*a* with the fluid leaving these wheel motors at ports A connected to a common line 305 for fluid flow over return line 306 to the inlet of the primary hydraulic pump 291. The pump means 287 also includes as a part thereof a supercharge pump 301 which supplies the makeup fluid. The supercharge pump is connected by a line 302 to the common reservoir 317 to receive therefrom makeup fluid for discharge over line 307 to pump 291.

The preferred hydraulic pump means 285 and 287 are Sunstrand 27 Series pumps operable at 1800 rpm, 158 gpm, and 1300 to 2000 psi. These pumps are manually adjustable as indicated by controls 308 to control the speed and direction of movement of the carriage and are, in a sense, a hydraulic transmission used in propelling the carriage 19 about the structure. These pump means 285 and 287 also include several conventional valves associated therewith and the supercharge pumps 299 and 301, all shown within the dotted boxes for the respective pumps means in FIG. 21.

To assure that the motors of the outer sets of wheels 93, 93*a*, 95*a* and 95*b* are hydraulically interconnected to receive substantially the same torque from their respective pumps 290 and 291, a cross flow fluid line 312 connects line 293 of the first primary pump 290 with line 303 from the second primary pump 291. Likewise, the return lines 297 and 306 to these primary pumps are connected by a cross flow line 314.

To filter and to cool the hydraulic fluid circulated by the primary pumps 290 and 291, drain lines 309 and 310 extend from these pumps to filters 318 and a line 310*a* extends from the filters to a Hyden heat exchanger 321 from which the filtered and cooled hydraulic fluid is discharged via line 325 to the common reservoir 317. As the filters and heat exchangers shown in FIG. 21 are conventional and commercially available units, they will not be explained in detail herein. Also, conventional motor control valves 311 and 313 are provided for the respective motors 290 and 291 and are connected to their respective high pressure lines 293 and 303 and their respective return lines 297 and 306. These motor control valves are also connected by lines 315 and 316 to the supercharge pumps 299 and 301, respectively.

The regenerative system, which is a closed loop system which is a fixed displacement and variable pressure system, comprises the regenerative hydraulic motor pumps 177 and 178 which are driven by the endless bands 31 and the tendon 17. The pump 177 is connected by a line 319 to a common high pressure line 320 extending to the inlet ports C of the motors for the inner set of wheels 96 and 96*a*. Outlet ports A from these wheel motors are connected to a common return line 322 which return fluid at a low pressure, for example, 200 to 250 psi, through a line 323 to return line 324 extending to inlet A of the pump 177. In a like manner, the other pump 178 is driven by the endless bands 31 and provides high pressure fluid over line 326 extending to a common line 327 connected to inlet ports C of the motors for the inner set of wheels 97 and 97*a*. On the outlet side, the lower pressure fluid returns from outlet ports A via a common line 328 to a line 330 extending to port A of the motor pump 178. Herein, each of the motor pumps 177 and 178, which are like Hagglund motors of the said kind as the motors 105 for the wheels, are driven at twice the rpm of motors 105 for the wheels 97, 972, and 96, 96*a* so that each single pump may supply fluid flow for a pair of wheel motors.

For the purpose of controlling the tension of the tendon 17 directly and to vary the fluid pressure in closed loop regenerative system between the pumps 177 and 178, an electrically controlled variable pressure pump means 331 indicated by the dotted box in FIG. 21 includes a variable pressure pump 332 which is controlled by an electrical valve 333 which in turn is controlled by the load cell means 35. In this instance, the valve 333 shifts a swash plate 334 in the variable pump 332 which controls the pressure and flow from the pump 332 outwardly to a line 337 extending to a pair of branching lines 338 connected to the high pressure side lines 319 and 326 from the respective pumps 177 and 178. The illustrated pump 332 is a 79 gpm pump made by Dennison with the Dennison pump usually pumping about 28 gpm for the makeup fluid to compensate for cross port leakage for the regenerative system loops having the pumps 177 and 178. Some of the fluid in regenerative loops does not return over the lines 324 and 330 to the pumps 177 and 178, but is diverted through lines 340 and 341 which interconnect with a common line 342 extending to a conventional Hyden heat exchanger means 345. From the heat exchanger 345, the fluid flows through a line 344 to a conventional filter device 343 from which the filtered fluid returns over a line 349 to the pump 332. A directional valve 348 is connected by a line 346 to the heat exchanger line 344 and by another line 349 to a safety relief valve 362 which operates should the pressure increase to over 3,000 psi to open and allow flow therethrough to low pressure line 340 when the carriage is being driven in the reverse direction. Another safety relief valve 364 is connected to the directional valve 348 and is operative when the carriage is traveling in the forward direction and the pressure in line 349 increases to over 3,000 psi to open and let fluid flow to the low pressure line 341. A further safety valve 365 is connected to the line 342 adjacent the heat exchanger 345 to open in the event of pressure buildup and to allow fluid to flow therefrom over line 366 to the common reservoir 317.

A supercharge pump 371, which is a portion of the pump means 331 and a part of the pump 334 is connected by a line 373 to the common reservoir 317 and is connected to the pump 332 to supercharge the regenerative system and to make up the missing flow due to leakage at the motor and pump cases. The supercharge pump 371 has an outlet line 373*a* extending to hydraulic motor hoists 49 of the suspension system 39 to act as a back pressure line for the hoists 49 and for the regenerative pump motors. This line 373*a* is connected to a line 374 extending to a line 375 leading to a group of safety valves 376 and this line 375 extends to join main outlet line 337a from the pump 332. At this latter juncture, another line 377 is connected to the line 337 to provide fluid flow to the motor hoists 49. Herein, the back pressure is usually about 250–350 psi.

It will be recalled that the tendon reel means 25 carrying the tendon 17 is held by a back tension to prevent free wheeling and to control the force needed to unwind the cable. Also, the tendon reel means needs to be driven in reverse direction to wind tendon on the spool 26 (FIG. 7) when the carriage is driven in the reverse direction. To these ends, a reel preload means 380 including a hydraulic motor 381 coupled to the spool 26 and a directional valve 383 are connected to a line 385 to receive fluid from a pump 387 which receives fluid from the reservoir via lines 389 and 373. Fluid from the back tension motor 381 may flow through the valve 383 and line 391 to the filters 318 for return to the reservoir 317. To drive the reel and its motor 381 in the opposite direction, another line 393 connected to the directional valve 383 extends to the supercharge pumps 299 and 301 of the primary motor means 285 and 287.

It will be seen from the foregoing that the primary and regenerative hydraulic drive systems are independent and operate at greatly different pressures with the high pressure motors for the primary wheels 95, 95*a*, and 93, 93*a* providing the greater portion of the traction drive. The normal force applied by the restraint system acts through the wheel arms 115 to force the wheel tires 107 against the structural wall and the torque arms 121 assure that all wheels contact the wall and allow the chains 99 to equalize the load between the respective wheels of the front sets of wheels and between the respective wheels of the rear set. The front and rear wheels driven by the primary pumps 290 and 291 are hydraulically interconnected and equalized by the lines 312 and 314 extending between their respective systems. Likewise, the front and rear regeneratively-driven wheels are likewise hydraulically interconnected. The speed of travel of the carriage 19 is controlled by manual controllers (not shown) for the primary pumps 290 and 291 to change their displacement. As the carriage speed increases, the pressure in the regenerative system drops and the Dennison pump is adjusted by the load cell means 35 to have a lower pressure output to maintain the pressure which would occur as a result of the system efficiencies. Herein, the torque applied to the wheel motors may be as much as 7,000 FT. LBS.; but with the elimination of the gear boxes of the patented apparatus, the breakdowns thereof, under high loads, have been eliminated. Moreover, the Hagglund pumps 177 and 178 are capable of maintaining this high torque and tension in the tendon even when the carriage 19 is standing still. Typically, the torque from the motors 105 is high, at least 6,000 FT. LBS., and may be as much as 12,000 FT. LBS. Preferably, diesel engines (not shown) are mounted on the carriage 19 to supply the electrical power and the mechanical power to drive the pumps and other mechanisms described above.

As an aid to understanding the invention, a brief review of the operation of the apparatus 11 will be given. The carriage 19 is preferably propelled by the traction drive means 23, which includes the direct drive hydraulic wheel motors 93, 93*a*, 95, 95*a*, 96, 96*a*, and 97, 97*a*, in a clockwise direction as seen in FIG. 1. One end of the tendon 17 is anchored to the wall of the structure; and as the carriage 19 travels forwardly, the tendon 17 is unwound from the reel means 25 and travels forwardly into the prestressing unit 28 at which the tendon is being stressed in tension by the pair of opposed sets of traveling restraint elements 33 on the pair of endless bands or chains 31. In one embodiment of the invention, the restraining elements 33 are constructed to be preloaded to provide a minimum load carrying capability before being shifted to accommodate tendon elongation. Herein, springs 249, FIGS. 17 and 18, are preloaded and compressed to a predetermined degree by shims 252 so that the stressing load is distributed more evenly and uniformly among all of the restaining elements 33 engaging the tendon whereby the normal force to hold the tendon provided by the backup plate 273 and the hydraulic jacks 276 may be reduced.

In another embodiment of the invention illustrated herein, as best seen in FIGS. 15 and 16, the restraint elements 33a are provided with differential friction surfaces which allow sliding of the tendon gripper block 255 relative to its support block 230a carried by the chains to accommodate elongation of the tendon during tension. The illustrated frictional surfaces includes a soft metallic high friction surface 256 for engaging the tendon directly without slipping while a polished surface 257 of a dissimilar metal slides on an abutted frictional surface 258 on the restraining block. The banging of the restraining elements against their supporting pins is alleviated by compression springs 269 which retard and absorb the energy of the blocks as they are being returned by other springs 261. These springs also center the restraining elements after release.

The restraining elements 33 or 33a pull the endless bands gripping the tendon 17 about the sprockets 180 (FIG. 14) and turn the motor hub extensions 181 of the regenerative motors 177 and 178 against the restraining force of the hydraulic fluid in the regenerative system.

Figure 3:
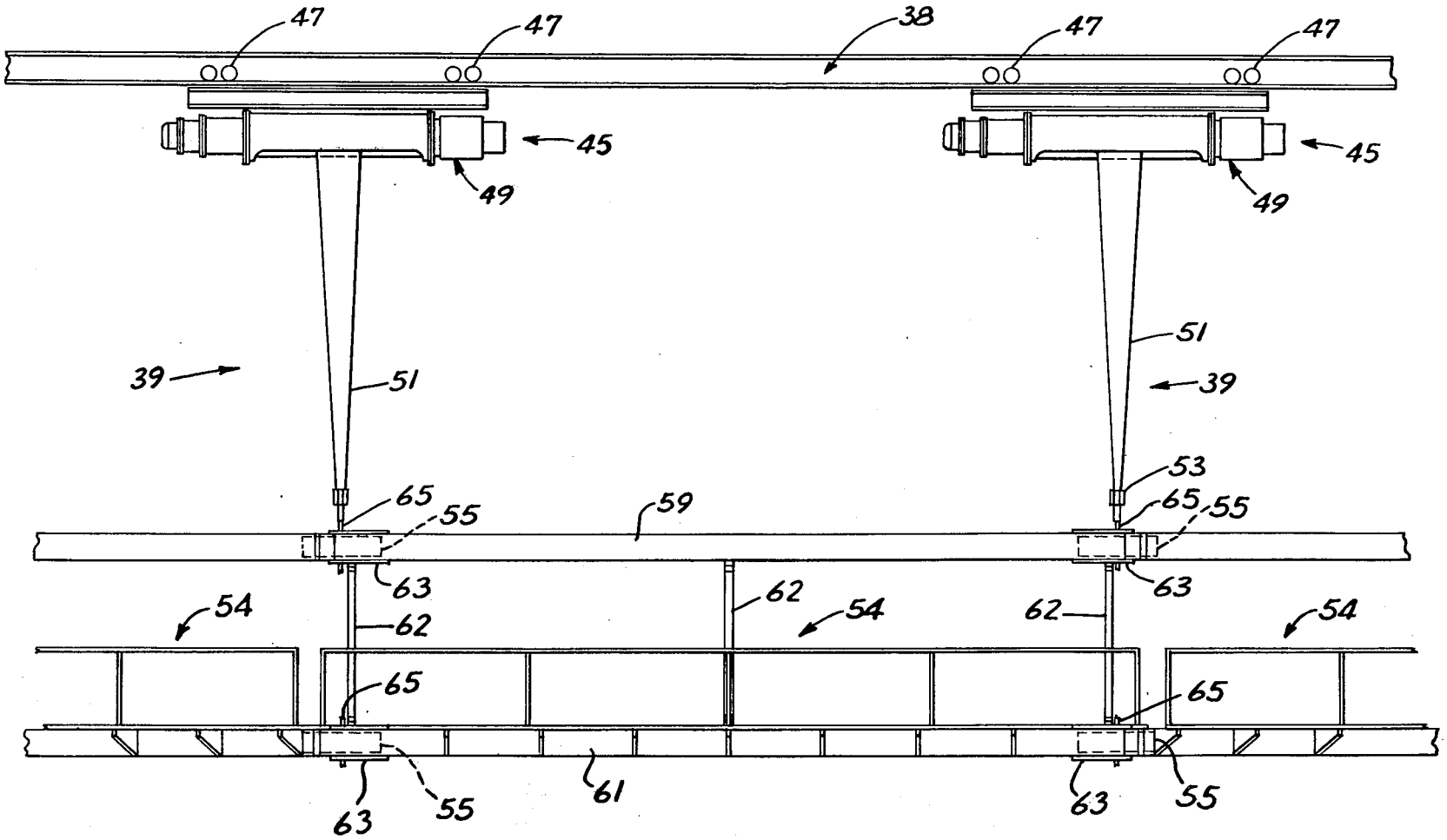
FIG. 3 is an elevational view of a portion of a suspension system for the banding apparatus.

The illustrated circumferential restraint system 21, for holding the traction drive means 23 against the structural wall 12 as the carriage 19 travels, includes a series of alternate wheeled and nonwheeled link units 54, as best seen in FIGS. 1 and 3, which are pivotally joined thereto and have wheels 55 rolling along the structural wall with travel of the carriage 19. The degree of normal force applied to the traction wheels and the degree of circumferential restraint is controlled by a takeup means, as best seen in FIG. 6, which can either extend or reduce the effective length of one of the link units 54.

The traction drive means 23 for moving the carriage comprises a direct drive from hydraulic motors which are operable at low rpm, for example, zero to 80 rpm, and at a high torque with an outer portion of each motor serving as a wheel. Herein, the outer portion of the hydraulic motor has a rotatable portion including an outer wheel 107 affixed thereto for engaging the structural wall 12. This direct drive eliminates the inefficiencies and the breakage experienced in the gear reducer drives used in prior art apparatus.

The prestressing unit 28 is mounted not only by an articulating means 29 to turn about a vertical axis to maintain the tangential path of tendon travel to the structural wall, but it is also mounted for turning about a second horizontal axis to eliminate any fleet angle bending in the downward direction. Particularly, as the carriage travels and pays out a tendon being packed against a wall of the tendon receiving groove, there is a tendency for the tendon to be pulled downwardly over the discharging groove rollers 217 of the prestressing unit. This force pivots the prestressing unit 28 downwardly to prevent a slight bending of the tendon, for example, a half degree, heretofore experienced. The turning of the prestressing unit 28 about a horizontal axis is accomplished by the circular bearing surfaces 163*a* and 164*a* on the stressing head plates 163 and 164 turning on the outer circular surfaces of housings 161, as best seen in FIG. 13. Also, movement of the prestressing unit 28 in a longitudinal direction without wedging and with minimal friction is achieved by the use of the linear bearings 160 mounting the prestressing unit 28 for sliding on the carrier 135 and by positioning the regenerative hydraulic motors 177 and 178 in positions, as seen in FIG. 11, to counterbalance the weight of the free end of the prestressing unit. Thus, in this manner, the prestressing unit 28 is provided with a gimbal mounting for turning about both the vertical and horizontal axis to maintain the tendon on a tangential path to the structural wall with a minimum of bending. Also, improved accuracy of tendon tensioning is provided by the use of a pair of load cells 35 supported and mounted by pivotally mounted links 221 and 223, as best seen in FIG. 12, which pivot and remain relatively uneffected by any bending loads as the prestressing unit tilts and turns.

The preferred hydraulic drive for the carriage 19 includes a fixed displacement, regenerative hydraulic system for the hydraulic pumps 177 and 178; this sytem responds more rapidly and accurately to changes in tendon tension caused by a change in travel speed of the carriage 19. More specifically, the hydraulic system disclosed in the aforementioned patent was a variable displacement system and hydraulic pressure changes as much as 400 psi resulted from a significant change in speed of travel of the carriages. However, this has been reduced significantly by providing an independent closed-loop regenerative hydraulic system including the regenerative pumps 177 and 178 and a variable pressure pump 332 for controlling the pressures in this closed loop system. The pump 332 is controlled by a valve 333 which in turn is operable by the load cells 35 to maintain the desired tendon tension, e.g., 30,000 pounds, as the carriage speed changes its speed of travel through its primary hydraulic system.

The latter hydraulic system is another closed loop system including the pumps 290 and 291 for driving the hydraulic motors for the wheels **95, 95*a*, 93, 93*a*. The remaining wheels 96, 96*a*, 97 and 97*a*, are driven by the regenerative system pumps 177 and 178. The primary system wheel motors are interconnected hydraulically to be driven at the same speed and are interconnected by means including chains 99 with the regenerative motors for the inner wheels 96, 96*a* and 97, 97*a* to prevent slippage and to share torque with one another. Each pair of wheels 95, 96; 95*a*, 96*a*; 93, 97 and 93*a*, 97*a* are mounted in a wheel assembly 111, as best seen in FIG. 9, which pivots about a vertical axis on a support 118 with a torque arm 121 extending from the wheel assembly 111 to the carriage frame support 118. This wheel assembly applies and distributes the normal force for traction drive through the wheel assemblies 111 to the respective wheels engaging the walls to assure all wheels are driving without slipping on the structural wall 12**.

From the foregoing, it will be seen that the abovedescribed apparatus provides an improved apparatus and method for banding with prestressed tendons particularly when operating at fast speeds and large sized tendons. The apparatus and method are particularly effective for commercial installations where breakdowns and failures cause significant problems for the construction of the structure.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. An apparatus for applying a circumferential prestressing tendon to a structure comprising a carriage movable about the peripheral wall of the structure, tendon tensioning means on said carriage for tensioning and paying out the tendon to the wall as said carriage travels in a forward direction, traction drive means for engaging the peripheral wall of the structure and for driving said carriage in a forward direction, restraining means connected to said carriage to form a band about said structure and applying to said carriage a force urging said traction drive means against the wall of the structure, said traction drive means comprising a plurality of hydraulic motors having a rotatable portion thereon, and an annular tire means mounted on each of said rotatable portions for engaging the wall and for acting as traction wheels for driving said carriage while tensioning said tendon.

2. An apparatus in accordance with claim 1 in which each of said hydraulic motors operate in the range from about 0 to 80 rpm and are capable of exerting at least 12,000 FT. LBS. of torque.

3. An apparatus in accordance with claim 2 in which said traction drive means comprises a primary hydraulic system for driving some of said wheel hydraulic motors and a regenerative hydraulic system for driving other wheel hydraulic motors, said regenerative system receiving power from said tendon tensioning means.

4. An apparatus in accordance with claim 3 in which a pair of said hydraulic motors driven by said primary hydraulic system are located at the forward end of the carriage, a pair of said hydraulic motors driven by said regenerative system are located at the forward end of said carriage, a connecting means connects said pairs of motors at the forward end of the carriage together, another pair of hydraulic motors are located at the rear end of the carriage and driven by said primary hydraulic system, another pair of said hydraulic motors driven by said regenerative system are located at said rear end of said carriage, and a connecting means connects said rear pairs of said hydraulic motors together.

5. An apparatus for applying a circumferential prestressing tendon to a wall of structure comprising a carriage movable about the peripheral wall of the structure, tendon tensioning means on said carriage for tensioning and paying out the tendon to the wall as said carriage travels in a forward direction, a first set of annular traction wheels engageable with the wall of said structure for driving said carriage about said wall, a primary hydraulic drive system having primary hydraulic motors for driving said first set of traction wheels, a second set of traction wheels engageable with the wall of said structure for driving said carriage about the wall, a regenerative hydraulic system independent of said primary hydraulic drive system connected to and driven by said restraining means to drive said second set of traction wheels and connected to said tendon tensioning means to receive a driving input from the tensioning of the tendon, means connecting said first and said second sets of traction wheels together to synchronize wheel rotations and to distribute the traction load therebetween, and a restraining means connected to said carriage for applying a force to said wheels in a direction normal to the structural wall to cause said wheels to maintain driving frictional engagement with said structural wall.

6. An apparatus in accordance with claim 5 in which said first set of traction wheels comprises a pair of forwardly and a pair of rearwardly disposed traction wheels on said carriage, said second set of traction wheels comprises a pair of forwardly and a pair of rearwardly disposed traction wheels on said carriage, said connecting means comprises chains extending between said forward wheels of said first and second sets of wheels and chains extending between said rearward wheels of said first and second sets of wheels.

7. An apparatus in accordance with claim 6 in which said connecting means further comprises vertically extending shafts extending between upper and lower wheels in each wheel set, sprockets fixed to upper and lower ends of said shafts and meshed with said chains to maintain the upper and lower wheels in synchronism.

8. An apparatus for applying a circumferential prestressing tendon to a wall of structure comprising a carriage movable about the peripheral wall of the structure, tendon tensioning means on said carriage for tensioning and paying out tensioned tendon to the wall as said carriage travels in a forward direction, traction drive means for engaging the peripheral wall of the structure and for driving said carriage in a forward direction, a restraining means connected to said carriage to form a band about said structure to apply a force to said traction means normal to the wall of said structure, said restraining means comprising a plurality of rigid linked units joined to each other at circumferentially spaced locations and to said carriage and extending circumferentially about said structure, said restraining means further comprising a plurality of wheels supporting said linked units and rolling about the structure wall as said restraining means is driven about said structure by said traction means.

9. An apparatus in accordance with claim 8 in which said restraining means comprises a takeup means which is adjustable to shorten the circumferential length of said restraining means to increase the force applied to said wheels and to said traction means in a direction normal to said structural wall, said takeup means also adjusting the length of said restraining means to loosen and to reduce the normal force to permit movement of said restraining means along said structure in a vertical direction.

10. An apparatus for applying a circumferential prestressing tendon to a wall of structure comprisng a carriage movable about the peripheral wall of the structure, tendon tensioning means on said carriage for tensioning and paying out the tendon to the wall as said carriage travels in a forward direction, traction drive means for engaging the peripheral wall of the structure and for driving said carriage in a forward direction, a restraining means connected to said carriage to form a band about said structure to apply a force to said traction means normal to the wall of said structure, said restraining means connected to opposite ends of said carriage and comprising a series of idler wheels spaced circumferentially about a structure and in rolling engagement with said wall of said structure.

11. A tendon tensioning mechanism for prestressing a tendon without substantially bending the tendon comprising a frame means, a support means mounted on said frame means, a pair of opposed endless bands mounted in said support means for movement about endless paths, a plurality of tendon restraining elements mounted on said endless bands for travel therewith and for forming a straight pathway for the tendon to travel along while engaging the tendon, said restraining elements having an outer frictional surface requiring a first force for slipping, said restraining elements having other frictional surfaces between said bands and said outer frictional surfaces for slipping with a substantially lesser force than said first force, said other frictional surfaces slipping with elongation of the tendon.

12. A tendon tensioning means in accordance with claim 11 in which a first spring means is operatively associated with said slidable restraining means to be compressed by sliding movement of said restraining element during elongation of the tendon, and a second spring means for restraining and centering the tendon element after release of the tendon.

13. A tendon tensioning mechanism in accordance with claim 11 in which said other frictional surfaces are harder and more polished than said first frictional surface engaging said tendon.

14. A tendon tensioning mechanism in accordance with claim 11 in which said restraining element comprises a block secured to said endless bands and a tendon gripping pad mounted on said block, said block and tendon gripping pad having mutually engaging surfaces disposed substantially parallel to said tendon and constituting said other frictional surfaces.

15. A tendon tensioning mechanism in accordance with claim 14 in which a force applying means applies a force normal to said mutually engaging surfaces and normal to said first frictional surfaces, said force applying means applying sufficient normal force to tension said tendon with the additional force caused by the tendon stretching causing said mutually engaging surfaces to slip.

16. A tendon tensioning mechanism for prestressing a tendon without substantially bending the tendon comprising a frame means, a support means mounted on said frame means, a pair of opposed endless bands mounted in said support means for movement about endless paths, a plurality of tendon restraining elements mounted on said endless bands for travel therewith and for forming a straight line pathway for the tendon to travel along while engaging the tendon, said restraining elements comprising a tendon engaging portion having a surface for gripping the tendon, and a supporting portion secured to said endless bands and supporting said tendon engaging portion, slidable frictional surfaces on said tendon engaging portion and said supporting portion for sliding relative to each other with elongation of said tendon, first spring means acting on said tendon engaging portion and being deflected in a first direction with shifting of said tendon engaging portion during elongation of said tendon, and second spring means acting on said tendon engaging portion when shifting in the opposite direction upon release of said tendon to position said tendon engaging portion at a predetermined position on said supporting portion.

17. A tendon tensioning mechanism in accordance with claim 16 in which a tendon engaging surface on said tendon engaging portion has a higher coefficient of friction than its said slideable frictional surface so that the latter will slide before the former slides on the tendon.

18. A tendon tensioning mechanism for prestressing a tendon without substantially bending the tendon comprising a frame means, a support means mounted on said frame means, a pair of opposed endless bands mounted in said support means for movement about endless paths, a plurality of tendon restraining elements mounted on said endless bands for travel therewith and for forming a straight line pathway for the tendon to travel along while engaging the tendon, and for allowing limited movement of said restraining elements relative to said bands to accomodate tendon elongation without slipping of the restraining elements on the tendon, a plurality of spring means biasing each of said restraining elements in a first direction including means for preloading each of said spring means to provide a predetermined spring force for said restraining elements resisting shifting relative to said endless bands with tensioning of said tendon.

19. A tendon tensioning mechanism in accordance with claim 8 in which said restraining element has a cavity therein receiving said spring means therein, and in which said means for preloading said spring means comprises shims for positioning at one end of said spring to provide a predetermined displacement of said spring means in each of said cavities.

20. A tendon tensioning mechanism in accordance with claim 19 in which said spring means comprises a pair of springs each mounted in one of said cavities in said restraining elements, a pin means securing said restraining elements to said endless bands, said cavities being cast in said restraining elements and varying in length, said shims being positioned in said cavities and having thicknesses varying with the length of the cavity to provide the desired preloading of said spring in its associated cavity.

21. Apparatus for prestressing a tendon and banding a wall of a structure with a tensioned tendon, said apparatus comprising, a carriage movable about the wall of said structure, means for moving said carriage to the structure wall, tendon tensioning means on said carriage for stressing the tendon while the tendon is held and moved along a substantially straight line path of movement without substantial bending stresses being applied to the tendon, and means mounting said tendon tensioning means for pivotal movement about a first axis in a first plane to position said tendon for travel along a tangent line from said tendon tensioning means to said structure wall and for pivotal movement about another axis and in an orthogonally intersecting plane to maintain a straight line travel for the tendon in the orthogonal plane.

22. Apparatus for prestressing a tendon in accordance with claim 21 in which said tendon tensioning means comprises a stressing unit having endless bands and restraining elements thereon movable in a longitudinal direct with the tendon, and in which said means mounting said tendon tensioning means for pivotal movement comprises a carrier means for supporting said prestressing unit, and in which linear bearing means supports said prestressing unit for longitudinal movement relative to said carrier means.

23. Apparatus for prestressing a tendon in accordance with claim 21 in which said means mounting said tendon tensioning means for pivotal movement comprises a housing means for said linear bearing means mounted in said carrier for turning about axis through said linear bearing means.

24. Apparatus for prestressing a tendon in accordance with claim 21 in which said tendon tensioning means comprises an elongated prestressing unit having endless bands and restraining elements movable in a longitudinal direction with the tendon to discharge the tensioned tendon at an outlet end of said elongated prestressing unit, and hydraulic motor means on said prestressing unit at said inlet end thereof and offsetting the weight of said outlet end of said prestressing unit from turning the same about said another axis.

25. Apparatus for prestressing a tendon in accordance with claim 21 in which said means pivotally mounting said tendon tensioning means comprises a carrier mounted on said carriage for turning about said first axis which is in a substantially vertical direction, said tendon tensioning means comprising a prestressing unit mounted in said carrier for turning about a substantially horizontal axis.

26. Apparatus for prestressing a tendon in accordance with claim 25 in which bearing means support said prestressing unit for shifting in a longitudinal direction relative to said carrier, load cell means measure the force exerted by the tendon on the prestressing unit tending to shift the latter longitudinally, and means mounting said load cell means are pivotally connected at one end to said carrier and pivotally connected at the other end to said prestressing unit to reduce the effect of bending loads on said load cell means.

27. Apparatus for prestressing a tendon and banding a wall of structure with a tensioned tendon, said apparatus comprising, a carriage movable about the wall of said structure, means for moving said carriage about the structure wall, tendon tensioning means on said carriage for stressing the tendon while the tendon is held and moved along a substantially straight line path of movement without substantial bending stresses being applied to the tendon, gimbal mounting means mounting said tendon tensioning means for turning about a vertical axis and about a horizontal axis, said means for moving said carriage comprising a plurality of hydraulic motors having outer rotatable portion and tire means mounted on said rotatable portion for acting as traction wheels to drive said carriage.

28. An apparatus in accordance with claim 27 in which said means for moving said carriage further comprises a primary hydraulic system for providing hydraulic fluid at a first pressure range for driving first ones of said hydraulic motors, and a regenerative hydraulic system connected to and receiving a power input from said tendon tensioning means and providing hydraulic fluid at a second pressure range for the other ones of said hydraulic motors, and means mechanically interconnecting said first ones and said other ones of said hydraulic motors together for turning said tractions at the same speed.

29. An apparatus in accordance with claim 27 in which said tendon tensioning means comprises a pair of endless bands each carrying opposed restraining elements having first portions with surfaces for frictional contact with said tendon, a second portion on said restraining elements mounting the latter on said endless bands, and slideable frictional surfaces on said first and second portion having lower coefficients of friction than said tendon contacting surfaces to allow said first portions to slide relative to said second portions to accommodate elongation of said tendon.

30. A method of tensioning a tendon and banding a circumferentially extending wall of a structure with the tensioned tendon by a tendon tensioning mechanism carried on a movable carriage; said method comprising the steps of: moving the carriage circumferentially about the wall, tensioning an extended linear portion of said tendon while said tendon is moving along a straight line path through said tendon tensioning mechanism, swinging said tendon tensioning mechanism about a vertical axis to maintain alignment of the tensioned linear portion of the tendon with a straight line tangent path from the tendon tensioning mechanism to the circumferential wall of the structure, tilting said tendon mechanism about a horizontal axis to eliminate bending of the tendon while discharging from said tendon tensioning mechanism, paying out said tensioned tendon along said straight line tangential path to said structure, and banding said circumferential wall with said tensioned tendon.

31. An apparatus for applying a circumferential prestressing tendon to a wall of structure comprising a carriage movable about the peripheral wall of the structure, tendon tensioning means on said carriage for tensioning and paying out tensioned tendon to the wall as said carriage travels in a forward direction, traction drive means for engaging the peripheral wall of the structure and for driving said carriage in a forward direction, a restraining means connected to said carriage to form a band about said structure to apply a force to said traction means normal to the wall of said structure, said restraining means comprising a plurality of rigid linked units joined to each other at circumferentially spaced locations and to said carriage and extending circumferentially about said structure, said restraining means further comprising a plurality of wheels supporting said linked units and rolling about the structure wall as said restraining means is driven about said structure by said traction means, said link units comprising a series of rigid trusses joined end to end and extending from one end of said carriage to the opposite end of said carriage, and means pivotally connecting said link units to each other and to the ends of said carriage.

32. An apparatus in accordance with claim 31 in which said wheels are vertically spaced and turn about vertical axes located adjacent each of said means pivotally connecting said link units to one another.

33. An apparatus for applying a circumferential prestressing tendon to a wall of structure comprising a carriage movable about the peripheral wall of the structure, tendon tensioning means on said carriage for tensioning and paying out tensioned tendon to the wall as said carriage travels in a forward direction, traction drive means for engaging the peripheral wall of the structure and for driving said carriage in a forward direction, a restraining means connected to said carriage to form a band about said structure to apply a force to said traction means normal to the wall of said structure, said restraining means comprising a plurality of rigid linked units joined to each other at circumferentially spaced locations and to said carriage and extending circumferentially about said structure, said restraining means further comprising a plurality of wheels supporting said linked units and rolling about the structure wall of said restraining means is driven about said structure by said traction means, said restraining means comprising a takeup means which is adjustable to shorten the circumferential length of said restraining means to increase the force applied to said wheels and to said traction means in a direction normal to said structural wall, said takeup means also adjusting the length of said restraining means to loosen and to reduce the normal force to permit movement of said restraining means along said structure in a vertical direction, said takeup means comprising a hydraulic cylinder means for shortening the effective length of one of said link units of said restraining means.

34. Apparatus for prestressing a tendon and banding a wall of structure with a tensioned tendon, said apparatus comprising, a carriage movable about the wall of said structure, means for mcving said carriage about the structure wall, tendon tensioning means on said carriage for stressing the tendon while the tendon is held and moved along a substantially straight line path of movement without substantial bending stresses being applied to the tendon, gimbal mounting means mounting said tendon tensioning means for turning about a vertical axis and about a horizontal axis, said means for moving said carriage comprisng a plurality of hydraulic motors having outer rotatable portion and annular tire means mounted on said rotatable portion for acting as traction wheels to drive said carriage, said tendon tensioning means comprising a pair of endless bands each carrying opposed restraining elements for gripping and tensioning the tendon, means mounting said restraining elements on said endless bands to permit shifting of said restraining elements with elongation of said tendon, and tuned springs biasing each of said restraining elements against shifting with a predetermined and substantially uniform force.

35. Apparatus for prestressing a tendon and banding a wall of a structure with a tensioned tendon, said apparatus comprising, a carriage movable about the wall of said structure, means for moving said carriage about the structure wall, tendon tensioning means on said carriage for stressing the tendon while the tendon is held and moved along a substantially straight line path of movement without substantial bending stresses being applied to the tendon, gimbal mounting means mounting said tendon tensioning means for turning about a vertical axis and about a horizontal axis, said means for moving said carriage comprising a plurality of hydraulic motors having outer rotatable portion and annular tire means mounted on said rotatable portion for acting as traction wheels to drive said carriage, said tendon tensioning means comprising a pair of endless bands each carrying opposed restraining elements having first portions with surfaces for frictional contact with said tendon, a second portion on said restraining elements mounting the latter on said endless bands, slideable frictional surfaces on said first and second portions having lower co-efficients of friction than said tendon contacting surfaces to allow said first portions to slide relative to said second portions to accommodate elongation of said tendon, first spring means resisting sliding movement of said first portions on said second portions in the direction of sliding to accommodate tendon elongation, and second spring means acting in the opposite direction to limit the return movement of said first portions upon release of said tendon.

* * * * *

UNITED STATES PATENT AND TRADEMARK OFFICE

CERTIFICATE OF CORRECTION

PATENT NO. : 4,005,828

DATED : February 1, 1977

INVENTOR(S) : Endre F. Peszeszer

It is certified that error appears in the above-identified patent and that said Letters Patent are hereby corrected as shown below:

| | |
|---|---|
| Col. 1, line 40, | "thereof" should be --thereto--. |
| Col. 4, line 29 | "I-beam into" should be --I-beam bent into--. |
| Col. 5, line 12 | "on the wall" should be --in the wall--. |
| Col. 5, line 50 | "havig" should be --having--. |
| Col. 5, line 61 | "11" should be --12--. |
| Col. 6, lines 35 and 36 | "beacuse" should be --because--. |
| Col. 7, line 32 | "U.s." should be --U.S.--. |
| Col. 9, line 13, | "tension" should be --tendon--. |
| Col. 10, line 40 | "pcked" should be --packed--. |
| Col. 11, line 56 | "its" should be --it--. |
| Col. 12, line 40 | "elongaed" should be --elongated--. |
| Col. 13, line 49 | "roller" should be --rollers--. |
| Col. 13, line 57 | "orr" should be --or--. |
| Col. 14, line 40 | "pum" should be --pump--. |
| Col. 14, line 50 | "to" , first occurrence, should be -- at --. |

UNITED STATES PATENT AND TRADEMARK OFFICE

CERTIFICATE OF CORRECTION

PATENT NO. : 4,005,828

DATED : February 1, 1977

INVENTOR(S) : Endre F. Peszeszer

It is certified that error appears in the above-identified patent and that said Letters Patent are hereby corrected as shown below:

continued:

| | |
|---|---|
| Col. 14, line 56 | "pumpp" (first occurrence) should be --pump-- |
| Col. 20, line 47 | after "of" insert --annular--. |
| Col. 22, line 4 | "straight pathway" should be --straight line pathway--. |
| Col. 23, line 22 | "Claim 8" should be --Claim 18--. |
| Col. 23, line 61 | "direct" should be --direction--. |
| Col. 25, line 2 | "portion" should be --portions--. |
| Col. 26, line 37 | "comprisng" should be --comprising--. |

Signed and Sealed this ninth Day of August 1977

[SEAL]

Attest:

RUTH C. MASON
*Attesting Officer*

C. MARSHALL DANN
*Commissioner of Patents and Trademarks*